US012382999B2

(12) United States Patent
Rendone

(10) Patent No.: US 12,382,999 B2
(45) **Date of Patent: *Aug. 12, 2025**

(54) QUICK-DRYING LIGHTWEIGHT BRA

(71) Applicant: Nike, Inc., Beaverton, OR (US)

(72) Inventor: Nicole Rendone, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/373,725

(22) Filed: Sep. 27, 2023

(65) Prior Publication Data

US 2024/0023642 A1 Jan. 25, 2024

Related U.S. Application Data

(62) Division of application No. 17/152,206, filed on Jan. 19, 2021, now Pat. No. 11,849,775.
(Continued)

(51) Int. Cl.
*A41C 3/00* (2006.01)
*A41C 3/12* (2006.01)
(Continued)

(52) U.S. Cl.
CPC ..... *A41C 3/0057* (2013.01); *A41C 3/0014* (2013.01); *A41C 3/0035* (2013.01);
(Continued)

(58) Field of Classification Search
CPC ... A41C 3/0057; A41C 3/0014; A41C 3/0035; A41C 3/0085; A41C 3/12; A41F 15/00; A41B 2400/20; A41B 2400/62
See application file for complete search history.

(56) References Cited

U.S. PATENT DOCUMENTS 4,781,651 A * 11/1988 Ekins ..... A41C 3/0057 450/25
6,083,079 A * 7/2000 Pearson ..... A41C 3/00 450/59
(Continued)

FOREIGN PATENT DOCUMENTS

CN 201418387 Y 3/2010
CN 105473015 A 4/2016
(Continued)

OTHER PUBLICATIONS

"Beilini Women's Sports Bra Wire Free Athletic Camisole Top with Lace", Amazon Fashion, amazon.com, ASIN: B075ZRDJS2, Sep. 28, 2017, 7 pages.
(Continued)

*Primary Examiner* — Khoa D Huynh
*Assistant Examiner* — Erick I Lopez
(74) *Attorney, Agent, or Firm* — SHOOK, HARDY & BACON L.L.P.

(57) ABSTRACT

Aspects herein are directed to a bra having a front portion formed with multiple layers of mesh to provide a supportive, modest bra that is breathable, lightweight, and quick drying. The front portion includes an interior support panel assembly having a first panel made of a mesh material and a second panel made of a spacer mesh material that is adjacent and external to the first panel. The front portion also includes an upper support panel made of a spacer mesh material and a lower support panel made of a mesh material that each are positioned adjacent and external to the interior support panel assembly. The upper support panel and the lower support panel are each defined by a top edge and a bottom edge, and at least a portion of the upper support panel bottom edge may be positioned superior to the lower support panel bottom edge.

20 Claims, 14 Drawing Sheets

Related U.S. Application Data

(60) Provisional application No. 62/963,809, filed on Jan. 21, 2020.

(51) Int. Cl.
*A41F 5/00* (2006.01)
*A41F 15/00* (2006.01)

(52) U.S. Cl.
CPC ..... *A41C 3/0085* (2013.01); *A41C 3/12* (2013.01); *A41F 15/00* (2013.01); *A41B 2400/20* (2013.01); *A41B 2400/62* (2013.01)

(56) References Cited

U.S. PATENT DOCUMENTS

| | | | | |
|---|---|---|---|---|
| 7,214,120 | B2 | 5/2007 | Kaye et al. | |
| 7,442,110 | B2 | 10/2008 | Gaudet et al. | |
| 7,591,706 | B2 | 9/2009 | Barbour et al. | |
| 7,946,904 | B1 | 5/2011 | Ciullo | |
| 8,523,629 | B2 | 9/2013 | Pundyk | |
| 10,201,192 | B1 | 2/2019 | Lott | |
| 10,206,436 | B1 * | 2/2019 | Wooley-Scheiman | A41C 3/0057 |
| 2004/0224603 | A1 * | 11/2004 | Kaye | A41C 3/10 450/1 |
| 2010/0005569 | A1 * | 1/2010 | Sanders | A41C 3/0057 2/400 |
| 2011/0223832 | A1 | 9/2011 | Rose et al. | |
| 2013/0122780 | A1 * | 5/2013 | McCall | A41C 3/10 450/36 |
| 2015/0056890 | A1 | 2/2015 | Black et al. | |
| 2016/0135512 | A1 * | 5/2016 | Smith | A41C 5/00 450/156 |
| 2016/0338423 | A1 | 11/2016 | Weber-unger | |
| 2017/0233906 | A1 | 8/2017 | Hwang | |
| 2018/0132541 | A1 | 5/2018 | Wittstadt et al. | |
| 2018/0132542 | A1 | 5/2018 | Abbaszadeh | |
| 2019/0216141 | A1 | 7/2019 | Witek et al. | |
| 2019/0387814 | A1 | 12/2019 | Carlino et al. | |
| 2021/0219628 | A1 | 7/2021 | Rendone | |

FOREIGN PATENT DOCUMENTS

| | | | |
|---|---|---|---|
| CN | 108669669 | A | 10/2018 |
| CN | 108685208 | A | 10/2018 |
| CN | 208490880 | U | 2/2019 |
| CN | 209359693 | U | 9/2019 |
| CN | 209660473 | U | 11/2019 |
| EP | 3087854 | B1 | 6/2018 |
| FR | 2908270 | B1 | 2/2010 |
| KR | 20-0416254 | Y1 | 5/2006 |
| KR | 20-0477370 | Y1 | 6/2015 |
| KR | 20-0483238 | Y1 | 4/2017 |
| KR | 20-0483514 | Y1 | 5/2017 |
| KR | 20-0484669 | Y1 | 10/2017 |
| KR | 10-1866870 | B1 | 6/2018 |
| KR | 10-1900902 | B1 | 9/2018 |

OTHER PUBLICATIONS

"Glamorise Double Layer Custom Control High Impact Sports Bra 1166", HerRoom, Available online at: <https://www.herroom.com / glamorise-1166-double-layer-custom-control-high-impact-sports-bra.shtml>, Feb. 20, 2018, 2 pages.

"Nike Sport Mesh Layered Midkini", Nike, Available online at: <www.nikeswim.com>, Feb. 2019, 3 pages.

Office Action received for Canadian Patent Application No. 3,167,007, mailed on Oct. 16, 2023, 3 pages.

"This Mesh Overlay Sports Bra Can Make Your Workouts Much More Fashionable", Revelist, Available online at: <www.revelist.com>, Nov. 29, 2018, 1 page.

Office Action received for European Application No. 21705361.0, mailed on Sep. 10, 2024, 4 pages.

* cited by examiner

QUICK-DRYING LIGHTWEIGHT BRA

CROSS-REFERENCE TO RELATED APPLICATIONS

This application is a divisional application of U.S. application Ser. No. 17/152,206 (filed Jan. 19, 2021), which claims the benefit of priority of U.S. Prov. App. No. 62/963,809 (filed Jan. 21, 2020). The entirety of each of the aforementioned applications is incorporated by reference herein.

TECHNICAL FIELD

Aspects herein relate to a quick-drying, lightweight bra formed with different mesh materials in a layered construction.

BACKGROUND

Conventional materials used for bras, particularly sports bras, typically offer support through heavy-weight materials that are not breathable and are not quick drying. Conversely, conventional bras constructed of lighter-weight, breathable fabrics do not typically offer sufficient support for many activities.

BRIEF DESCRIPTION OF THE DRAWINGS

Examples of aspects herein are described in detail below with reference to the attached drawings figures, wherein.

DETAILED DESCRIPTION

Figure 1:
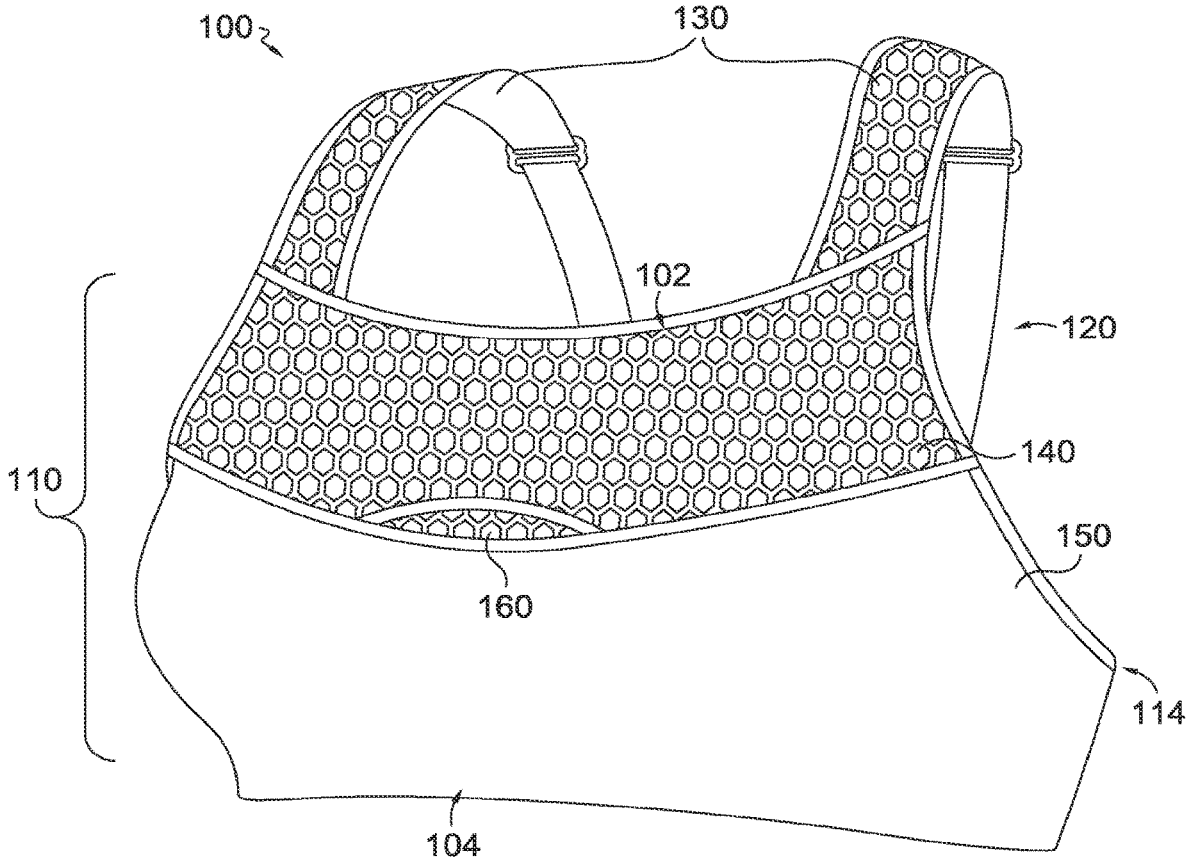
FIG. 1 illustrates a front perspective view of an example quick-drying, lightweight bra in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to identify different elements of methods employed, the terms should not be interpreted as implying any particular order among or between various steps herein disclosed unless and except when the order of individual steps is explicitly stated.

Bras that are worn during athletic activities, such as sport bras, generally need to provide sufficient support for the wearer's breasts. At the same time, because physical activity often causes a wearer's body temperature to rise and the wearer to perspire, it may be desirable for a bra to be breathable and dry quickly. Support is conventionally provided through the use of heavier fabrics that tend to not be very breathable or quick drying. As such, conventional bras often lack either sufficient support or sufficient breathability and the ability to dry quickly. Aspects herein provide for a bra constructed from multiple layers of different materials, such as mesh materials. The mesh materials help provide a lightweight bra with breathability and quick drying properties, while layering mesh materials with different properties, including different stretch properties, provides coverage and support that is desired during physical activity.

At a high level, aspects herein are directed to a bra that includes an interior support panel assembly, an upper support panel, and a lower support panel that collectively form at least a front portion of the bra. The upper support panel and the lower support panel may each be positioned adjacent and external to the interior support panel assembly, creating a multi-layered construction in at least some areas of the front portion of the bra. In various aspects, a combination of spacer mesh material and mesh material (which may also be referred to herein as non-spacer mesh material) forms different panels of the front portion of the bra. For example, the upper support panel may be formed of a spacer mesh material while the lower support panel may be formed of a mesh material.

In example aspects, the upper support panel includes an upper support panel top edge and an upper support panel bottom edge while the lower support panel includes a lower support panel top edge and a lower support panel bottom edge. The upper support panel is arranged generally superior to the lower support panel on the external side of the interior support panel assembly. As such, the upper support panel top edge may form an upper margin of the front portion of the bra while the lower support panel bottom edge may form the lower margin of the front portion. Additionally, at least a portion of the upper support panel bottom edge may be positioned superior to at least a portion of the lower support panel top edge.

In example aspects, at least a portion of the lower support panel top edge is unaffixed from the interior support panel assembly. A pocket opening may be formed from the unaffixed lower support panel top edge, where the pocket opening is in communication with a pocket space formed between the lower support panel and the interior support panel assembly.

In example aspects, the interior support panel assembly includes a first panel and a second panel each extending between a right side and a left side of the front portion. The second panel may be positioned adjacent and external to the first panel. Further, the second panel may include a third panel affixed to a right side of the second panel and configured to at least partially cover a wearer's right breast and a fourth panel affixed to a left side of the second panel and configured to at least partially cover the wearer's left breast. In example aspects, the first panel is formed from a mesh material while the second panel is formed from a spacer mesh material. The spacer mesh material may exhibit less stretch than the mesh material of the first panel in at least the vertical direction. Additionally, in example aspects, the third panel and the fourth panel are formed from material having less stretch relative to the first and second panels.

In example aspects, the bra includes a back portion also formed from at least one panel of mesh material. A pair of shoulder straps may extend between the front and back portions, and each shoulder strap may be at least partially formed of a spacer mesh material.

Example aspects of the present disclosure also include a method of manufacturing a multi-layered bra that includes a front portion having an upper support panel, a lower support panel, and an interior support panel assembly. The method may include forming the front portion of the bra by affixing the upper support panel to the interior support panel assembly at one or more locations such that the upper support panel is positioned adjacent to a first surface of the interior support panel assembly. The front portion of the bra may also be formed by affixing the lower support panel to the interior support panel assembly at one or more locations such that the lower support panel is also positioned adjacent to the first surface of the interior support panel assembly. Additionally, when the upper support panel and the lower support panel are affixed to the interior support panel assembly, at least a portion of a lower support panel top edge may be positioned inferior to at least a portion of the upper support panel bottom edge. Further, in some aspects, the upper support panel may include an upper support panel top edge that forms an upper margin of the front portion of the bra, and the lower support panel may include a lower support panel bottom edge that forms a lower margin of the front portion.

Layering both the upper support panel and the lower support panel over the interior support panel assembly creates additional support to the wearer in the front portion of the bra, at least partly, due to increased layers. The additional layers also provide coverage by decreasing transparency. The front portion of the bra, however, remains breathable and quick drying due to the open structure of the mesh and spacer mesh materials used to form the upper support panel, the lower support panel, and the interior support panel assembly. Additionally, by utilizing different types of mesh material with differing properties, including varying stretch properties, different levels of support may be achieved in the upper portion and the lower portion of the bra. For example, in aspects having the third and fourth panels of a lower stretch material secured to the interior support panel assembly, additional support is provided to particular breast-covering portions of the front portion of the bra.

As used herein, the term "bra" encompasses any structure configured to be worn around a wearer's torso and at least partially cover the wearer's breasts. Although aspects herein are discussed with respect to a bra, it is understood that the disclosed technology is not limited to a bra and may be applied to any upper-torso garment used to support breast tissue, such as camisoles, swimwear, tank tops, or other garments with built-in breast support.

Positional terms used when describing the bra, such as front, sides, back, interior-facing surface, exterior-facing surface, superior, inferior, interior exterior, and the like, are used with respect to the bra being worn as intended with the wearer standing upright such that the lower portion of the bra extends around the wearer's torso and the upper portion of the bra is positioned generally over the wear's chest. As such, the interior-facing surface of the bra is configured to be positioned adjacent to a skin surface of the wearer, and the exterior-facing surface faces away from the skin surface. Additionally, the front portion of the bra is configured to at least partially cover the wearer's breasts while the back portion is configured to at least partially cover the wearer's back. Additionally, shoulder straps are configured to extend over the wearer's shoulder from the front portion to the back portion and at least partly define openings through which the wearer's arms extend and an opening through which the wearer's head and neck extend. It should be understood, however, that use of positional terms do not depend on the actual presence of a human being for interpretative purposes.

The term "mesh" refers to a textile material with a plurality of closely-spaced openings. The mesh material may be knitted (warp knitted or weft knitted) or woven. In example aspects, the term mesh refers to a loosely knit or woven material such that the openings are integrally knit or woven into the material. In other aspects, the openings may be formed in a post-knitting or post-weaving step using, for example, laser cutting, water jet cutting, die cutting, and the like after the textile is knitted or woven.

The term "spacer" mesh refers to a spacer textile formed of a mesh material. Spacer textiles are generally formed by utilizing at least one tie yarn (also known as a spacer yarn) to interconnect first and second layers of textile. Thus, a spacer mesh, as used herein, includes a first textile layer and a second textile layer with at least one of the layers having a mesh construction and also includes a third layer that interconnects the first and second layers. The third layer may include one or more monofilament or multifilament yarns that interknit or interweave the first and second layers. In some aspects, the first layer and the second layer of the spacer mesh each have a mesh construction. In other aspects, only one of the first layer or the second layer have the mesh construction. In knitted spacer mesh textiles, spacer yarns have "loop" portions that extend into each of the first layer and the second layer where the loop portions are interlooped with yarns in the first layer and the second layer to connect the two layers. In general, the longitudinal length of the spacer yarn is oriented perpendicular, or near perpendicular, to the planar surfaces of both the first and second layers for knitted or woven spacer mesh textiles.

The term "stretch property", as used herein, refers to a characteristic of a panel of material relating to the ability to stretch in response to a force. A stretch property may refer to a material's capability of stretching under force generally or to a material's capability of stretching so as to return to an original shape or size when the force is released, which may be also referred to as elasticity. A measure of a stretch property herein may be a modulus of elasticity, which is a measure of a material's resistance to being deformed elastically when stress is applied. A modulus of elasticity may be determined in various manners. In some aspects, the modulus of elasticity values described herein were determined according to a test methodology specified by ASTM D 4964. Further, other material properties are described herein that may also be determined in various manners. For example, air permeability scores provided herein may be determined according to a test methodology specified by ASTM D 737, and drying times may be determined according to a test methodology specified by AATCC 201.

Additionally, there are various numerical measurements provided herein. Unless indicated otherwise, the term "about" with respect to a measurement means within ±10% of the indicated value. Further, unless indicated otherwise, all measurements provided herein are with respect to the bra being in a resting state (i.e., a non-stretched) at standard ambient temperature and pressure (298.15 K and 100 kPa).

Figure 2:
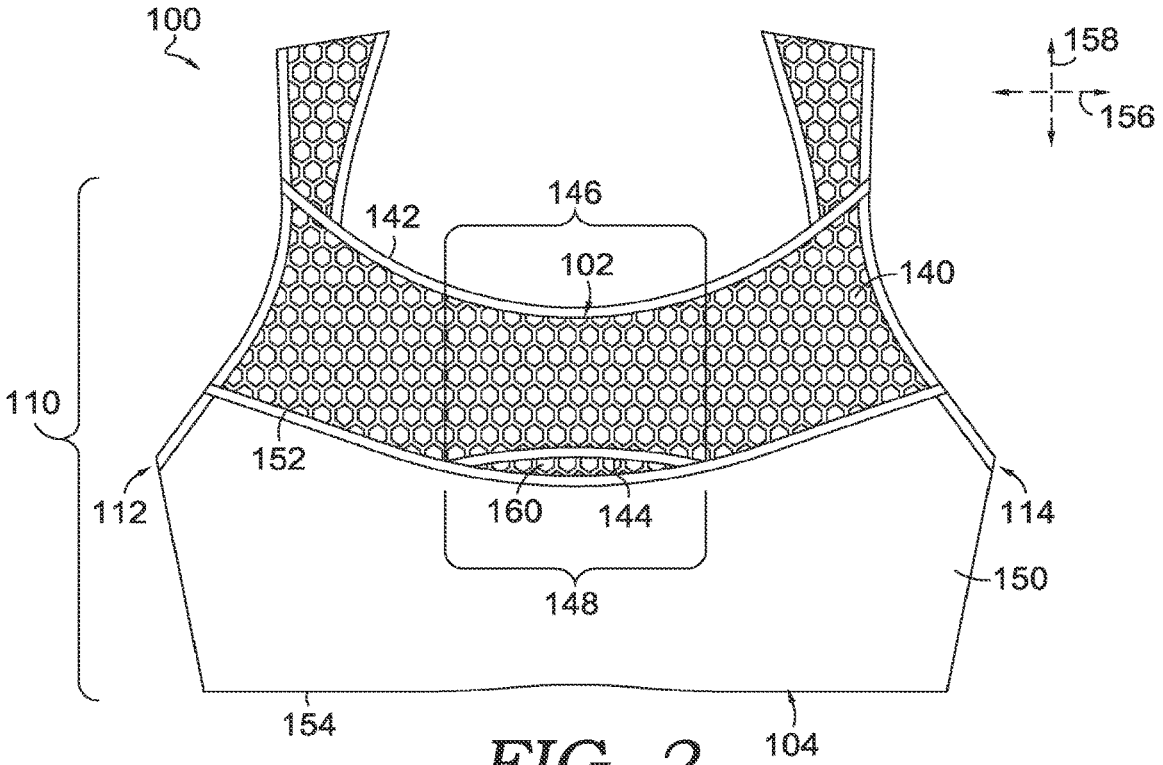
FIG. 2 illustrates a front view of the bra of FIG. 1 in accordance with aspects herein.

FIGS. 1-2 depict a front perspective view and a front view of an example bra 100, respectively. In various aspects, the bra 100 may be targeted toward a wearer desiring a high amount of support. The bra 100 includes a front portion 110 that typically covers at least a portion of the wearer's chest when the bra 100 is in an as-worn configuration and a back portion 120 that typically covers at least a portion of the wearer's back when the bra 100 is in the as-worn configuration. The bra 100 may also include a pair of front shoulder straps 130, each extending between the front portion 110 and the back portion 120.

The front portion 110 of the bra 100 includes an upper margin 102 including a superior edge that at least partially defines a neck opening and a lower margin 104 including an inferior edge that at least partially defines a torso opening of the bra 100. Additionally, the front portion 110 has a width extending between a right side 112 and a left side 114 of the bra 100. In some aspects, the width of the front portion 110 extends across the wearer's breasts when the bra 100 is in the as-worn configuration. Thus, the front portion 110 may also be referred to, for example, as a breast-covering portion.

In various aspects, the front portion 110 includes a plurality of mesh panels. For example, FIG. 1 depicts the front portion 110 including an upper support panel 140 and a lower support panel 150. The upper support panel 140 and the lower support panel 150 collectively form an exterior assembly of the front portion 110 of the bra 100.

The upper support panel 140 extends from the right side 112 to the left side 114 of the front portion 110 and is defined, at least partially, by an upper support panel top edge 142 and an upper support panel bottom edge 144. Similarly, the lower support panel 150 extends from the right side 112 to the left side 114 of the front portion 110 and is defined, at least partially, by a lower support panel top edge 152 and a lower support panel bottom edge 154. Both the upper support panel 140 and the lower support panel 150 may extend seamlessly from the right side 112 to the left side 114. As referred to herein, the term "seamlessly" means extending continuously and without interruption. A panel that extends seamlessly between two reference areas is formed of a single panel piece as opposed to multiple panel pieces joined along their edges by seams.

In various aspects, the upper support panel top edge 142 forms the upper margin 102 of the front portion 110. Similarly, the lower support panel bottom edge 154 forms the lower margin 104 of the front portion 110. As illustrated in FIGS. 1-2, the lower margin 104 of the front portion 110 may also be the lower margin of the bra 100. However, it is contemplated that one or more additional panels of material (e.g., underband panels, for example) may be secured to the front portion 110 such that the additional panels form the lower margin of the bra 100.

Although the upper support panel 140 is generally positioned superior to the lower support panel 150, there may be some overlap between the upper support panel 140 and the lower support panel 150. In some aspects, at least about 50% of the upper support panel 140 is superior to the lower support panel 150. In some aspects, at least about 75% to about 95% of the upper support panel 140 is superior to the lower support panel 150. Partially overlapping the upper support panel 140 and the lower support panel 150 provides additional layers and, therefore, additional coverage in breast-covering regions when the bra 100 is in the as-worn configuration.

As shown in FIGS. 1-2, where the upper support panel 140 and the lower support panel 150 overlap, at least a portion of the upper support panel bottom edge 144 is positioned inferior to the lower support panel top edge 152. Additionally, in some aspects, another portion of the upper support panel bottom edge 144 is positioned superior to the lower support panel top edge 152. For example, a middle portion 146 of the upper support panel bottom edge 144 between the right side 112 and the left side 114 is positioned superior to a middle portion 148 of the lower support panel top edge 152 in FIGS. 1-2. Lateral portions of the lower support panel top edge 152 proximate to the right side 112 and left side 114 are positioned superior to respective lateral portions of the upper support panel bottom edge 144. In some aspects, at least a portion of the lower support panel 150 may be positioned external to the upper support panel 140. For example, at least a portion of the lower support panel top edge 152 may be positioned external to the upper support panel 140. However, it is contemplated that, in alternative aspects, the entirety of the lower support panel top edge 152 may be positioned superior to the upper support panel bottom edge 144. In other alternative aspects, the entirety of the upper support panel bottom edge 144 may be superior to the lower support panel top edge 152 such that the upper support panel 140 and the lower support panel 150 do not overlap.

The upper support panel 140 and the lower support panel 150 are both formed from mesh materials. In various aspects, the upper support panel 140 and the lower support panel 150 are formed from mesh materials having different properties. For example, the upper support panel 140 may be constructed from a spacer mesh while the lower support panel 150 may be constructed from a non-spacer mesh. The spacer mesh of the upper support panel 140 and the non-spacer mesh of the lower support panel 150 may have different stretch properties.

In various aspects, the upper support panel 140 is formed from a spacer mesh having a first modulus of elasticity. For example, the first modulus of elasticity may be within a range from about 0.1 lb. forces to about 0.5 lb. forces at a width loop tension of 40% or from about 0.1 lb. forces to about 0.3 lb. forces at a width loop tension of 40%. In some aspects, the first modulus of elasticity is about 0.3 lb. forces at a width loop tension of 40%.

In various aspects, the spacer mesh forming the upper support panel 140 may have anisotropic stretch properties such that the amount of stretch differs along different axes. For example, the amount of stretch along the widthwise direction corresponding to axis 156 is different than the amount of stretch along the lengthwise direction corresponding to axis 158. As used herein, "widthwise direction" refers to the direction parallel to the width of the bra 100 from the right side 112 to the left side 114, while "lengthwise direction" refers to the direction parallel to the length of the bra 100 from the upper margin 102 to the lower margin 104. In example aspects in which a material disclosed herein, such as the spacer mesh material of the upper support panel 140, is knitted, widthwise direction may correspond to a course-wise direction parallel to the knit courses, and lengthwise direction may correspond to a wale-wise direction parallel to the knit wales. In various aspects, the upper support panel 140 may have more stretch in the widthwise direction compared to the lengthwise direction. For instance, the amount of stretch of the upper support panel 140 within the widthwise direction may be within a range from about 1.5 to about 3.5 times, within a range from about 2 to about 3 times, or about 2.67 times the amount of stretch within the lengthwise direction.

In one example, the first modulus of elasticity is in the widthwise direction, and a second modulus of elasticity may be in the lengthwise direction. In some aspects, the first modulus of elasticity may be within a range from about 0.1 lb. forces to about 0.5 lb. forces at a width loop tension of 40% or from about 0.1 lb. forces to about 0.3 lb. forces at a width loop tension of 40%, while the second modulus of elasticity may be within a range of about 0.5 lb. forces to about 1.5 lb. forces at a width loop tension of 40% or from about 0.8 lb. forces to about 1.3 lb. forces at a width loop tension of 40%. In one example aspect, the first modulus of elasticity in the widthwise direction may be about 0.3 lb. forces with a width loop tension of 40% while the second modulus of elasticity in the lengthwise direction may be greater than 0.3 lb. forces with a width loop tension of 40%, thus limiting the stretch in the lengthwise direction.

The open mesh structure of the spacer mesh material also allows for breathability and quick drying properties of the upper support panel 140, which may provide increased comfort to the wearer. For example, in one aspect, the spacer mesh forming the upper support panel 140 may have an air permeability score, after three washes, within a range from about 200 $cm^3/s/cm^2$ to about 240 $cm^3/s/cm^2$, within a range from about 210 $cm^3/s/cm^2$ to about 230 $cm^3/s/cm^2$, within a range from about 215 $cm^3/s/cm^2$ to about 225 $cm^3/s/cm^2$, or about 221 $cm^3/s/cm^2$. Further, the spacer mesh material forming the upper support panel 140 may have an example dry time, after washes, within a range from about 10 minutes to about 15 minutes, within a range from about 11.5 minutes to 13.5 minutes, or about 12.46 minutes.

In contrast to the upper support panel 140, the lower support panel 150 includes a non-spacer mesh material having different stretch properties than the spacer mesh material. In some aspects, the lower support panel 150 has a third modulus of elasticity within a range from about 1.5 lb. forces to about 3 lb. forces at a width loop tension of 40% or from about 1.5 lb. forces to about 2.2 lb. forces at a width loop tension of 40%. In some examples, the third modulus of elasticity may be about 2.2 lb. forces at a width loop tension of 40%.

In various aspects, the non-spacer mesh forming the lower support panel 150 includes anisotropic stretch properties such that the amount of stretch along the widthwise direction corresponding to axis 156 is different than the amount of stretch along the lengthwise direction corresponding to axis 158. As such, the third modulus of elasticity of the lower support panel 150 may be in the widthwise direction is about 2.2 lb. forces at a width loop tension of 40%, while a fourth modulus of elasticity of the lower support panel 150 may be in the lengthwise direction. While the spacer material of the upper support panel 140 may have more stretch in the widthwise direction compared to the lengthwise direction, examples of the non-spacer material of the lower support panel 150 may have more stretch in the lengthwise direction than in the widthwise direction.

Additionally, in some aspects, the difference between the amount of stretch of the lower support panel 150 in the widthwise and lengthwise directions is less than the difference between the amount of stretch of the upper support panel 140 in the two directions. For example, the amount of stretch of the lower support panel 150 within the lengthwise direction may be within a range from about 1.1 to about 2.5 times, within a range from about 1.5 to about 2 times, or about 1.65 times the amount of stretch within the widthwise direction. In contrast, as previously stated, the amount of stretch of the upper support panel 140 within the widthwise direction may be within a range from about 1.5 to about 3.5 times, within a range from about 2 to about 3 times, or about 2.67 times the amount of stretch within the lengthwise direction.

The different mesh materials of the upper support panel 140 and the lower support panel 150 may be used to create increased support while still allowing for a bra that is breathable, lightweight, and quick drying. For example, the upper support panel 140 being formed from a material with less stretch in the lengthwise direction allows the upper support panel 140 to reduce vertical upward movement of the wearer's breasts during physical activity. At the same time, more stretch in the widthwise direction can provide for increased comfort and ease when donning and doffing the bra 100.

Additionally, the open mesh structures of both the spacer mesh material of the upper support panel 140 and the non-spacer mesh material of the lower support panel 150 help to maintain the lightweight characteristic of the bra 100. For example, in one aspect, the material of the lower support panel 150 has a weight from about 15 grams per square meter to about 200 grams per square meter. In another aspect, the material has a weight within a range from about 25 grams per square meter to about 180 grams per square meter. In one example aspect, the non-spacer mesh material of the lower support panel 150 may have a weight from about 25 grams per square meter to about 150 grams per square meter, or about 100 grams per square meter. In some aspects, the spacer mesh material of the upper support panel 140 may have a greater weight than the non-spacer mesh material of the lower support panel 150. For example, the upper support panel 140 may have a weight within a range from about 100 grams per square meter to about 450 grams per square meter, within a range from about 200 grams to about 375 grams per square meter, or about 300 grams per square meter.

In some aspects, the front portion 110 of the bra 100 may include one or more additional layers to provide support and coverage. While the upper support panel 140 and the lower support panel 150 form an exterior portion of the front portion 110, the front portion 110 may also include an interior support panel assembly 160 positioned interior to the upper support panel 140 and the lower support panel 150.

Figure 3:
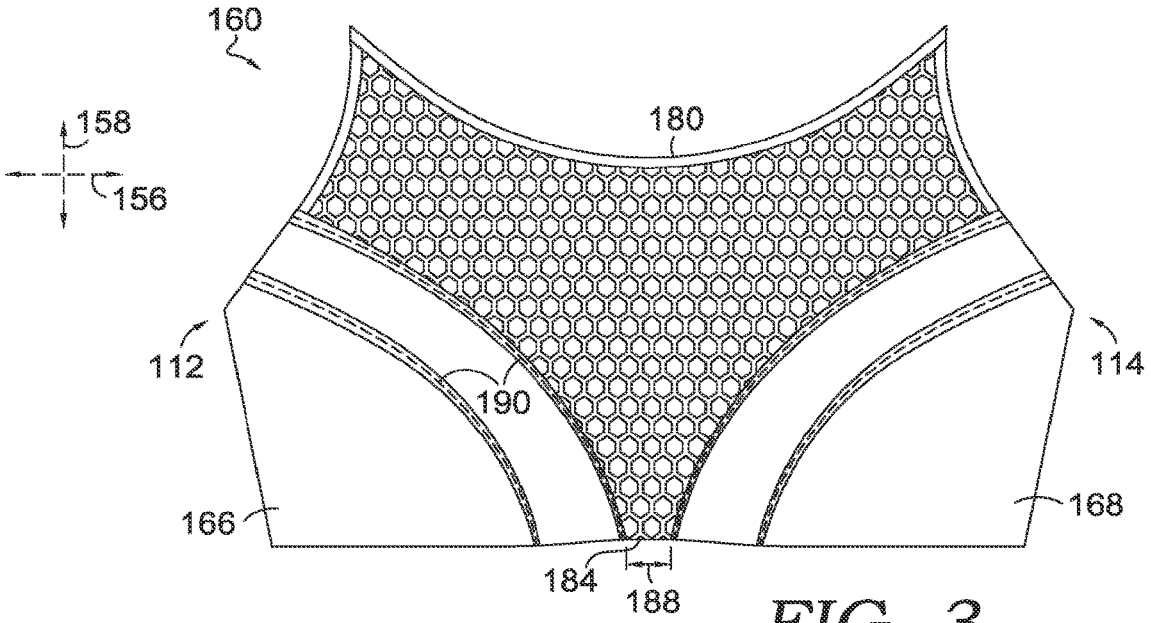
FIG. 3 illustrates a front view of an interior support panel assembly of the bra of FIG. 1 in accordance with aspects herein.
Figure 4:
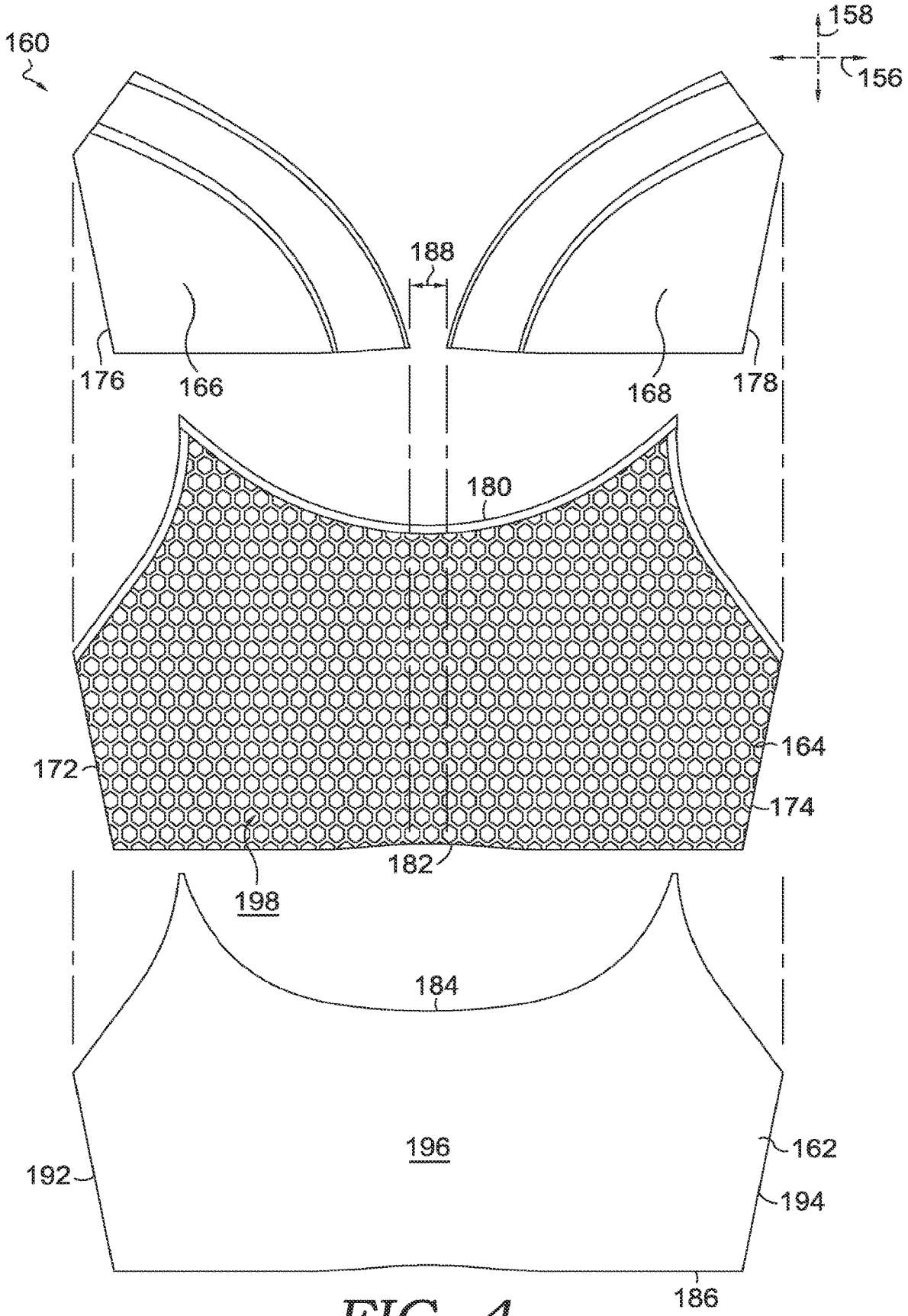
FIG. 4 illustrates an exploded view of the interior support panel assembly of FIG. 3, in accordance with aspects herein.

FIGS. 3-4 depict a front view and an exploded view, respectively, of an example interior support panel assembly 160. The interior support panel assembly 160 includes a plurality of panels of mesh materials, including a first panel 162 extending seamlessly from the right side 112 to the left side 114 of the front portion 110. Adjacent to and external to the first panel 162 is a second panel 164 that also extends from the right side 112 to the left side 114 of the front portion 110. Specifically, the second panel 164 may be positioned adjacent to and external to at least a portion of the exterior-facing surface 196 of the first panel 162 such that the second panel 164 overlays at least a portion of the first panel 162.

The first panel 162 and the second panel 164 each extend from the right side 112 to the left side 114 of the front portion 110 of the bra 100. Thus, the first and second panels 162 and 164 may have the same or substantially the same width. The first panel 162 and the second panel 164 may also each extend from a top edge 184 to a bottom edge 186 of the front portion 110 of the bra 100. Thus, the first and second panels 162 and 164 may have the same or substantially the same length. In other words, the first panel 162 and the second panel 164 may have substantially the same size and shape. As used herein, "substantially" refers to ±0.5 inch with reference to length, width, and size.

In various aspects, all or at least most of the first panel 162 is positioned underneath or interior to the second panel 164. A right-side lateral edge 172 of the second panel 164 may align with a right-side lateral edge 192 of the first panel 162, and a left-side lateral edge 174 of the second panel 164 may align with a left-side lateral edge 194 of the first panel 162 when the bra 100 is assembled. Further, the top edge 180 of the second panel 164 may align with the top edge 184 of the first panel 162 while the bottom edge 182 of the second panel 164 may align with the bottom edge 186 of the first panel 162 when the bra 100 is assembled. The first panel 162 and the second panel 164 may be joined together while maintaining their seamless constructions. For example, in some aspects, the first panel 162 and the second panel 164 are affixed along their respective perimeters while the surfaces of the panels 162 and 164 remain uncoupled. In this way, the first panel 162 and the second panel 164 have a greater range of motion relative to each other, providing more comfort to the wearer.

The first panel 162 and the second panel 164 of the interior support panel assembly 160 are both formed from mesh materials. In various aspects, the first panel 162 and the second panel 164 may be formed from mesh materials having different properties. For example, the first panel 162 may be formed from a non-spacer mesh material while the second panel 164 may be formed from a spacer mesh material having different properties, including different stretch properties, compared to the first panel 162.

In various aspects, the non-spacer mesh material of the first panel 162 has anisotropic stretch properties such that the amount of stretch along the widthwise direction corresponding to axis 156 is different than the amount of stretch along the lengthwise direction corresponding to axis 158. In other words, the first panel 162 may have a fifth modulus of elasticity in the widthwise direction and a sixth modulus of elasticity in the lengthwise direction that is less than the fifth modulus of elasticity. In example aspects, the first panel 162 includes the same non-spacer mesh material as the lower support panel 150 such that the first panel 162 may have the same stretch and weight properties describes with respect to the lower support panel 150.

In other aspects, the first panel 162 may include a non-spacer mesh that has a lesser amount of stretch than the lower support panel 150. For example, the non-spacer mesh material may include a warp knit mesh formed with polyester yarns and elastomeric yarns such as, for example SPANDEX® or elastane. In various aspects, the non-spacer mesh may include a combination of polyester and elastane. The amount of polyester forming the non-spacer mesh may be within a range from about 70% to about 85% or within a range from about 75% to about 80%, while the amount of elastane may be within a range from about 30% to about 15% or within a range from about 25% to about 20%. For example, in one aspect, the non-spacer mesh has a composition of about 78% polyester and about 22% elastane.

In contrast to the first panel 162, the second panel 164 may be formed from a spacer mesh that may also have different amounts of stretch along different axes. For example, the second panel 164 may have more stretch in the widthwise direction corresponding to axis 156 compared to the lengthwise direction corresponding to axis 158. In an example aspect, the spacer mesh forming the second panel 164 is the same material used to form the upper support panel 140 such that a seventh modulus of elasticity of the second panel 164 along the widthwise direction may be the same as the first modulus of elasticity of the upper support panel 140. In some example aspects, the seventh modulus of elasticity along the widthwise direction may be within a range from about 0.1 lb. forces to about 0.5 lb. forces at a width loop tension of 40% or from about 0.1 lb. forces to about 0.3 lb. forces at a width loop tension of 40%, while an eighth modulus of elasticity along the lengthwise direction may be within a range of about 0.5 lb. forces to about 1.5 lb. forces at a width loop tension of 40% or from about 0.8 lb. forces to about 1.3 lb. forces at a width loop tension of 40%. In one aspect, the seventh modulus of elasticity along the widthwise direction may be about 0.3 lb. forces at a width loop tension at 40%, while the eighth modulus of elasticity along the lengthwise direction may be greater than 0.3 lb. forces with a width loop tension of 40%, thus limiting the stretch in the lengthwise direction. Additional properties, including stretch and weight, described with respect to the spacer mesh material of the upper support panel 140 may be applicable to the second panel 164.

Layering the first panel 162 and the second panel 164 provides additional support and coverage of the wearer's breasts while still allowing the interior support panel assembly 160 to be breathable and quick drying due to the open mesh structures of the first panel 162 and the second panel 164.

In various aspects, the interior support panel assembly 160 also includes a third panel 166 and a fourth panel 168 that are positioned adjacent to and external to the second panel 164. Specifically, each of the third panel 166 and the fourth panel 168 may be positioned adjacent to at least a portion of the exterior-facing surface 198 of the second panel 164 such that the third panel 166 and the fourth panel 168 each overlay at least a portion of the second panel 164.

In example aspects, the third panel 166 and the fourth panel 168 each include a warp-knit tricot material. In one aspect, the tricot material is formed of nylon yarns. The tricot material of the third panel 166 and the fourth panel 168 may include a low stretch characteristic. For example, the tricot material may have minimal to zero stretch in at least one direction. As such, the third panel 166 and the fourth panel 168 each have a ninth modulus of elasticity that is greater than at least the seventh modulus of elasticity of the second panel 164. The higher modulus of elasticity (and, thus, less stretch) of the third panel 166 and the fourth panel 168 provides additional support and durability to breast-covering regions of the front portion 110 of the bra 100.

The third panel 166 and the fourth panel 168 may be configured to cover a majority of or all of the wearer's breast tissue such that the decreased stretch provided by the third panel 166 and the fourth panel 168 provides additional support directly to the wearer's breasts. For example, the third panel 166 may be positioned towards the right side 112 of the front portion 110 to cover a wearer's right breast while the fourth panel 168 may be positioned towards the left side 114 to cover a wearer's left breast. In various aspects, the third panel 166 includes a right-side lateral edge 176 that aligns with the right-side lateral edge 172 of the second panel 164, and the fourth panel 168 includes a left-side lateral edge 178 that aligns with the left-side lateral edge 174 of the second panel 164.

The third panel 166 and the fourth panel 168 may be the same or substantially the same size and shape. For example, the third panel 166 and the fourth panel 168 may be mirror-images of each other. In aspects where the third panel 166 and the fourth panel 168 are secured to the second panel 164, the third panel 166 and the fourth panel 168 may be spaced apart so they do not directly contact one another. As such, there may be a minimum spacing 188 between the third panel 166 and the fourth panel 168 to allow for space between the low stretch material in a medial area of the interior support panel assembly 160. This medial area may align with an area between the wearer's breasts in which undesirable perspiration may collect during physical activity. The minimum spacing 188 at this medial area allows for easier donning and doffing of the bra 100, as well as increased breathability between the breasts.

In various aspects, the third panel 166 and the fourth panel 168 are coupled to the second panel 164 by stitching. For example, the third panel 166 and the fourth panel 168 each may be coupled to the second panel 164 with one or more lines of interlocking stitches 190 that also add support within a breast-contacting region by limiting stretch at the seam lines.

Figure 5:
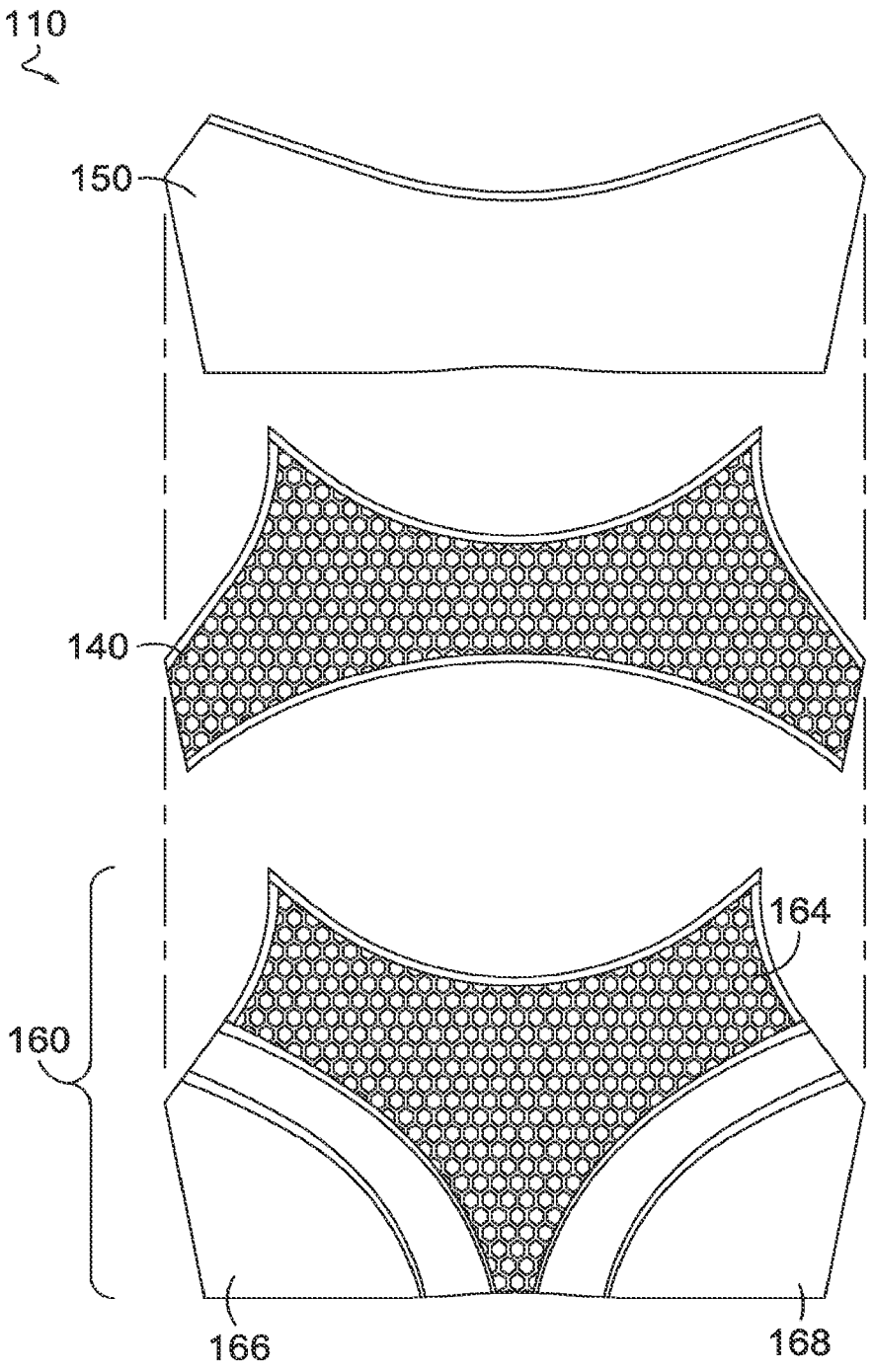
FIG. 5 illustrates a partially exploded view of a front portion of the bra of FIG. 1, in accordance with aspects herein.

FIG. 5 depicts a partially exploded view of the front portion 110 of the bra 100. The interior support panel assembly 160 (as depicted in the view in FIG. 5) is positioned interior to the upper support panel 140 and the lower support panel 150. In aspects in which the upper support panel 140 and the lower support panel 150 overlap, at least a portion of the upper support panel 140 may be positioned interior to the lower support panel 150.

Figure 6:
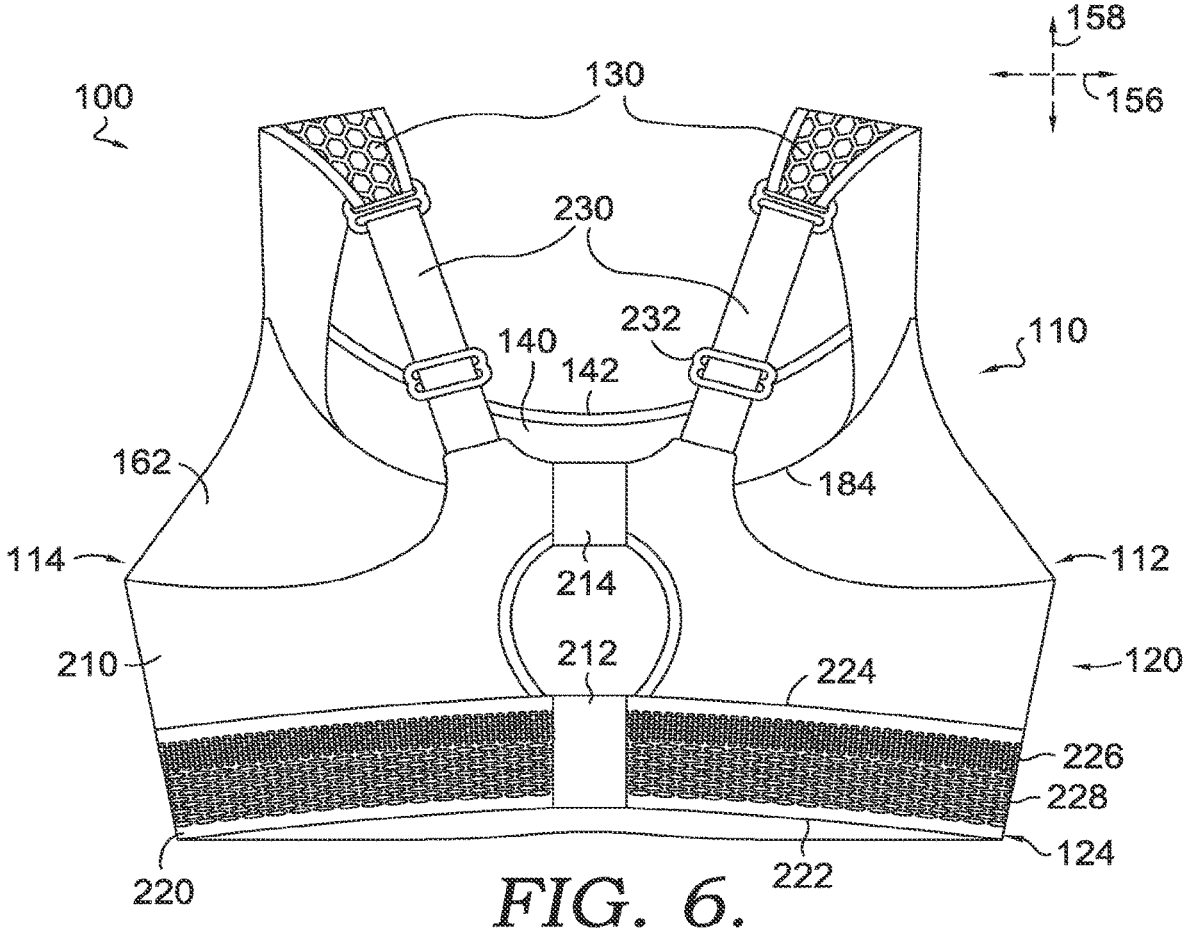
FIG. 6 illustrates a back view of the bra of FIG. 1 in accordance with aspects herein.

FIG. 6 depicts a back view of the bra 100. As illustrated in this back view, the first panel 162 of the interior support panel assembly 160 forms the innermost layer of the front portion 110 of the bra 100. Additionally, when the interior support panel assembly 160 is coupled to the upper support panel 140, the upper support panel top edge 142 may be positioned superior to the top edge 184 of the first panel 162 of the interior support panel assembly 160. Although not visible in the view depicted in FIG. 6, in aspects in which the second panel 164 of the interior support panel assembly 160 aligns with the first panel 162, the upper support panel top edge 142 may similarly be positioned superior to the top edge 180 of the second panel 164. This arrangement permits additional coverage of a wearer's upper breasts by the upper support panel 140 while limiting the number of panels of material over the wearer's upper breasts, thereby increasing breathability and comfort.

FIG. 6 also depicts a back portion 120 of the bra 100. The back portion 120 may include a back panel 210, a lower band 220, and a pair of back shoulder straps 230. The back panel 210 may extend from the right side 112 of the bra 100 to the left side 114 of the bra 100 and be configured to cover at least a portion of a wearer's back. In various aspects, the back panel 210 is joined to one or more panels of the front portion 110 along seams at the right side 112 and the left side 114. In alternative aspects, the back panel 210 is continuous with one or more panels of the front portion 110, such as, for example, the first panel 162 of the interior support panel assembly 160.

In various aspects, the back panel 210 includes a mesh material. Specifically, the back panel 210 may be formed from a non-spacer mesh material. In various aspects, the back panel 210 is formed with a different non-spacer mesh material than the non-spacer mesh material forming the lower support panel 150. In some aspects, the non-spacer mesh material forming the back panel 210 has less stretch than the non-spacer mesh material forming the lower support panel 150. The back panel 210 may have different amounts of stretch along the widthwise axis 156 and the lengthwise axis 158. In some aspects, the back panel 210 has a greater amount of stretch (and thus a lower modulus of elasticity) along the lengthwise direction compared to the widthwise direction.

In example aspects, the back panel 210 may include a warp knit mesh. Further, the back panel 210 may be formed with polyester yarns and elastomeric yarns such as, for example SPANDEX® or elastane. In various aspects, the non-spacer mesh of the back panel 210 may include a combination of polyester and elastane. The amount of polyester forming the non-spacer mesh may be within a range from about 70% to about 85% or within a range from about 75% to about 80%, while the amount of elastane may be within a range from about 30% to about 15% or within a range from about 25% to about 20%. For example, in one aspect, the non-spacer mesh has a composition of about 78% polyester and about 22% elastane. Additionally, non-spacer mesh of the back panel 210 may be heavier than the non-spacer mesh of the lower support panel 150. In some aspects, the mesh forming the back panel 210 may have a weight within a range from about 190 grams per square meter to about 240 grams per square meter or from about 105 grams per square meter to about 225 grams per square meter. For example, in one aspect, the weight is about 216 grams per square meter. Although heavier in weight, the back panel 210 may be breathable and dry quickly due to the open mesh structure.

The back panel 210 may be coupled to or at least proximate to a top edge 224 of the lower band 220. The lower band 220 may include an elastic band that at least partially encircles the wearer's torso. The lower band 220 may make up at least a portion of an underband of the bra 100 such that the bottom edge 222 of the lower band 220 may form a lower margin 124 of the back portion 120 of the bra 100. In various aspects, the lower band 220 is omitted on the front portion 110 of the bra 100, extending across only the back portion 120 of the bra 100 and joining one or more panels of the front portion 110 at the right side 112 and the left side 114. Alternatively, the lower band 220 may extend across the front portion 110 as well so that the lower band 220 may be configured to completely encircle the torso of the wearer when the bra 100 is in an as-worn configuration. In this example, the lower band 220 may be positioned between the lower support panel 150 and the second panel 164 of the interior support panel assembly 160 or may be positioned between the second panel 164 and the first panel 162 of the interior support panel assembly 160.

In various aspects, the lower band 220 includes a plurality of apertures to increase air flow to the wearer's skin. In some aspects, different size apertures are positioned throughout the lower band 220. For example, in FIG. 6, a top portion of the lower band 220 includes apertures 226 of a first size and the bottom portion of the lower band 220 includes apertures 228 of a second size that is larger than the first size.

The back panel 210 may also be coupled to the back shoulder straps 230, which may each include an elastic strap with an adjustment mechanism 232, such as the strap slides depicted in FIG. 6. The back shoulder straps 230 may be coupled to the front shoulder straps 130 of the front portion 110. In some aspects, when the bra 100 is worn, the front shoulder straps 130 each extend over the apex of a wearer's shoulder such that the front shoulder straps 130 extend at least partly down the wearer's back before coupling with the back shoulder straps 230.

The back portion 120 may also include one or more closure mechanisms. For example, the back portion 120 in FIG. 6 includes a first clasp 212 for releasably coupling two ends of the lower band 220 and a second clasp 214 for releasably coupling two portions of the back panel 210. It is contemplated, however, that bra 100 may have more, may have less, or may have no releasable closure mechanisms.

Figure 7:
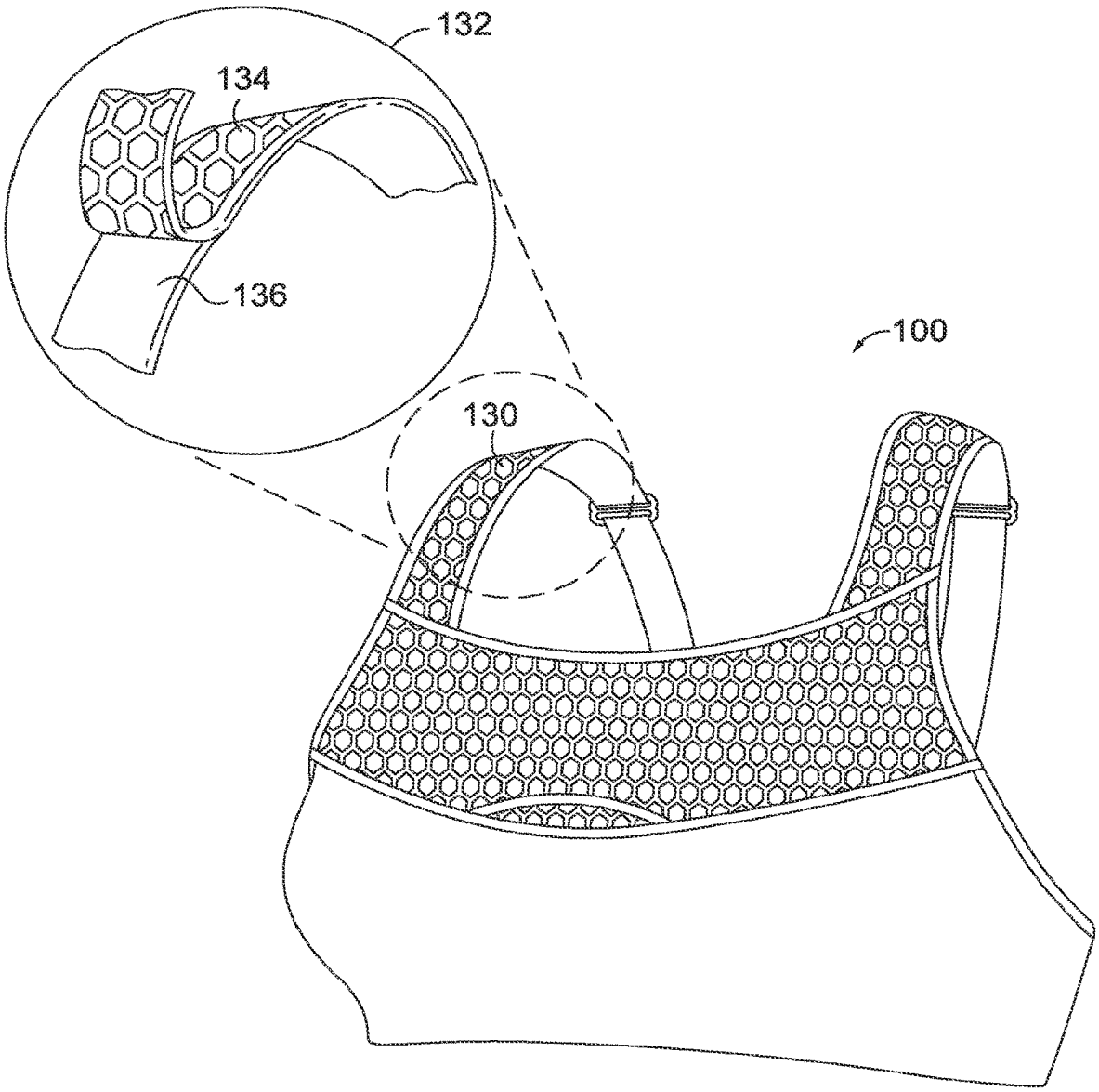
FIG. 7 illustrates a front perspective view of the bra of FIG. 1 with a partially deconstructed view of a front shoulder strap in accordance with aspects herein.

FIG. 7 depicts a front perspective view of the bra 100 with a partially exploded view 132 of one of the front shoulder straps 130. As illustrated, in example aspects, the front shoulder straps 130 may have a two-layered construction. A first strap panel 134 of the front shoulder strap 130 may be exterior to and overlay a second strap panel 136 of the front shoulder strap 130. The first strap panel 134 and the second strap panel 136 may be formed with different types of mesh materials. For example, the first strap panel 134 may include a spacer mesh material while the second strap panel 136 may include a non-spacer mesh material. In various aspects, the first strap panel 134 is formed with the same spacer mesh material as the upper support panel 140 while the second strap panel 136 may be formed from the same non-spacer mesh material as the first panel 162 of the interior support panel assembly 160 or as the lower support panel 150. Because the spacer mesh material may have less stretch in the lengthwise direction, forming the first strap panel 134 from the spacer mesh material reduces stretch in the lengthwise direction, which helps maintain support to the wearer's breasts, while still providing comfort and ease in donning and doffing due to more stretch in the widthwise direction.

Figure 8:
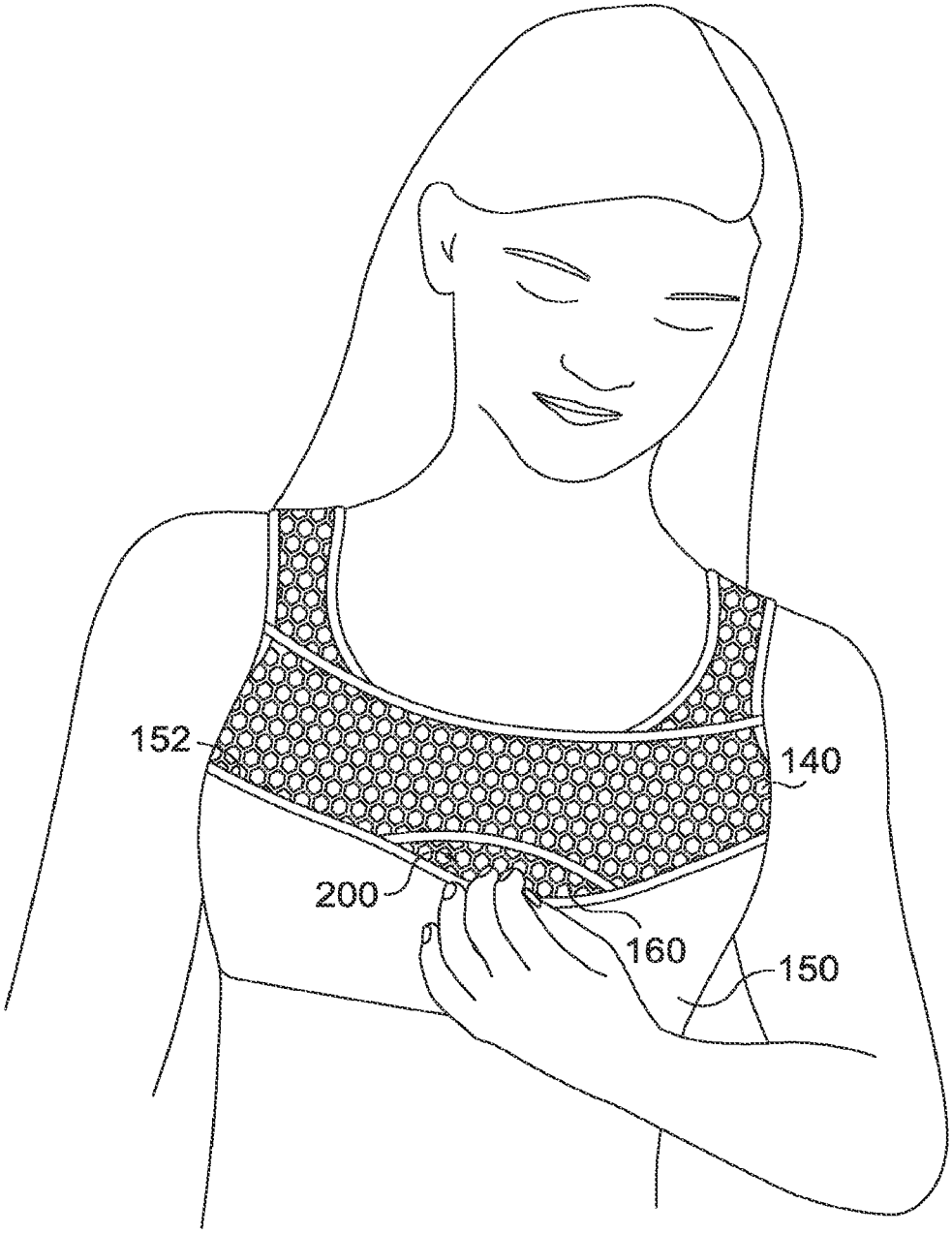
FIG. 8 illustrates a front perspective view of the bra of FIG. 1 with a pocket in an open configuration in accordance with aspects herein.

FIG. 8 depicts a front view of the bra 100 in the as-worn configuration. In some aspects in which there is overlap between the upper support panel 140 and the lower support panel 150, the lower support panel 150 may be positioned external to the upper support panel 140, and at least a portion of the lower support panel top edge 152 may remain unsecured from the upper support panel 140. For example, in FIG. 8, at least a portion of the lower support panel top edge 152 is not secured to the upper support panel 140, allowing the wearer to access a pocket space 200 between the lower support panel 150 and the interior support panel assembly 160 by pulling down on the unsecured portion of the lower support panel top edge 152, which acts as a pocket opening. The pocket space 200 between the lower support panel 150 and the interior support panel assembly 160 may be used by the wearer to store items, such as a mobile phone, a key, or an identification card.

Figure 9:
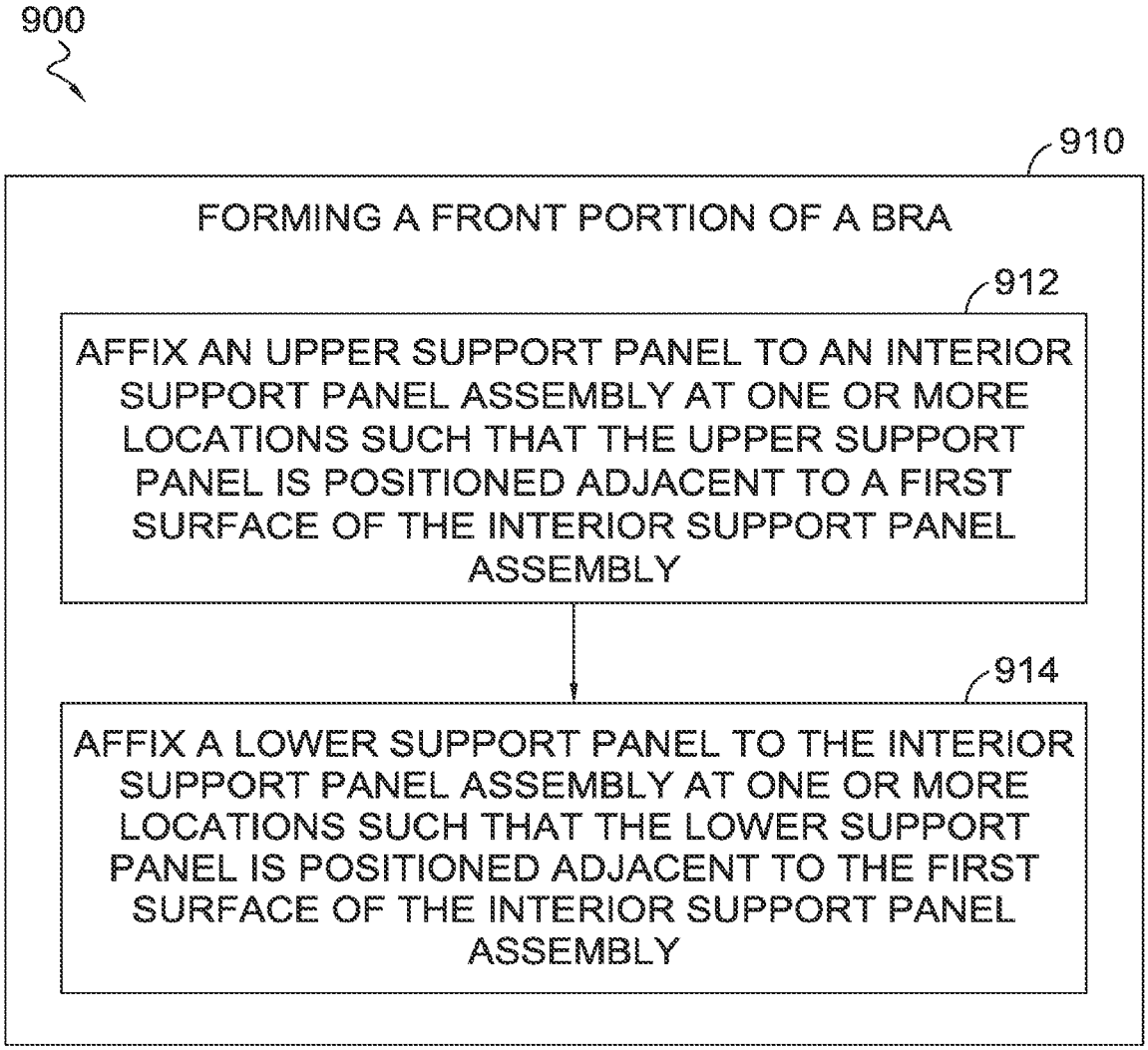
FIG. 9 illustrates a flow diagram of an example method for manufacturing a quick-drying, lightweight bra in accordance with aspects herein.

FIG. 9 depicts a flow diagram of an example method 900 of manufacturing a bra, such as the bra 100. The bra manufactured in accordance with method 900 includes a right side, a left side, an upper margin, and a lower margin. At step 910, a front portion of the bra is formed. Forming a front portion, such as the front portion 110, of the bra may include steps 912 and 914. At step 912, an upper support panel, such as the upper support panel 140, may be affixed at one or more locations to an interior support panel assembly, such as the interior support panel assembly 160. The upper support panel may be affixed to the interior support panel assembly such that the upper support panel is positioned adjacent to a first surface, such as the exterior-facing surface 198, of the interior support panel assembly. At step 914, a lower support panel, such as the lower support panel 150, may be affixed at one or more locations to the interior support panel assembly. The lower support panel may be affixed to the interior support panel assembly such that the lower support panel is also positioned adjacent to the first surface of the interior support panel assembly. Affixing the lower support panel and the upper support panel to the interior support panel assembly may include stitching each of the lower support panel and the upper support panel to the interior support panel assembly along the perimeter edges of the respective panels; however, it is contemplated that other means of affixing the panels may be used, such as tacking, adhesive, or bonding.

The upper support panel may include an upper support panel bottom edge, such as the upper support panel bottom edge 144, while the lower support panel may include a lower support panel top edge, such as the lower support panel top edge 152. Affixing the lower support panel to the interior support panel assembly at step 914 may include positioning the lower support panel such that the lower support panel top edge is positioned inferior to at least a portion, such as the middle portion 146, of the upper support panel bottom edge. Additionally, in various aspects, the upper support panel also includes an upper support panel top edge, such as the upper support panel top edge 142, that forms an upper margin of the front portion of the bra while the lower support panel also includes a lower support panel bottom edge, such as the lower support panel bottom edge 154, that forms a lower margin of the front portion. In some aspects, the one or more locations for affixing the upper support panel to the interior support panel assembly are along the left side, the right side, and the upper support panel top edge while the upper support panel bottom edge may remain unsecured to the interior support panel assembly. Alternatively, the upper support panel bottom edge may also be affixed to the interior support panel assembly. Additionally, the one or more locations for affixing the lower support panel to the interior support panel assembly are along the left side, the right side, and the lower support panel bottom edge while the lower support panel top edge may remain unsecured to the interior support panel assembly. Alternatively, the lower support panel top edge may also be affixed to the interior support panel assembly.

In some aspects, the method 900 also includes forming the interior support panel assembly by affixing a first panel, such as the first panel 162, at one or more locations to a second panel, such as the second panel 164, such that the second panel is positioned adjacent to a second surface, such as the exterior-facing surface 196, of the first panel. In various aspects, the first panel and the second panel are substantially the same shape and size, and they may be affixed together only along their perimeters. Forming the interior support panel assembly may occur prior to steps 912 and 914, and the first surface to which the upper support panel and the lower support panel are adjacent may be a surface, such as the exterior-facing surface 198, of the second panel.

In some aspects, forming the interior support panel assembly may also include affixing a third panel, such as the third panel 166, and a fourth panel, such as the fourth panel 168, at one or more locations to the second panel such that the third panel and the fourth panel are each positioned adjacent to a third surface, such as the exterior-facing surface 198, of the second panel. Affixing the third panel and the fourth panel may include forming one or more sets of interlocking stitches, such as the interlocking stitches 190, between the third panel and the second panel and forming one or more sets of interlocking stitches between the fourth panel and the second panel. Additionally, at least one set of interlocking stitches may extend within the middle of the third panel such that the stiches are not limited to the perimeter of the third panel and at least one set of interlocking stitches may extend within the middle of the fourth panel such that stitches are not limited to the perimeter of the fourth panel.

In various aspects, the method 900 also includes a step for affixing the front portion to a back portion, such as the back portion 120, of the bra. The method 900 also includes affixing the front portion to one or more shoulder straps, such as the front shoulder straps 130. The method 900 may include additional steps further contemplated within the present disclosure.

Figure 10:
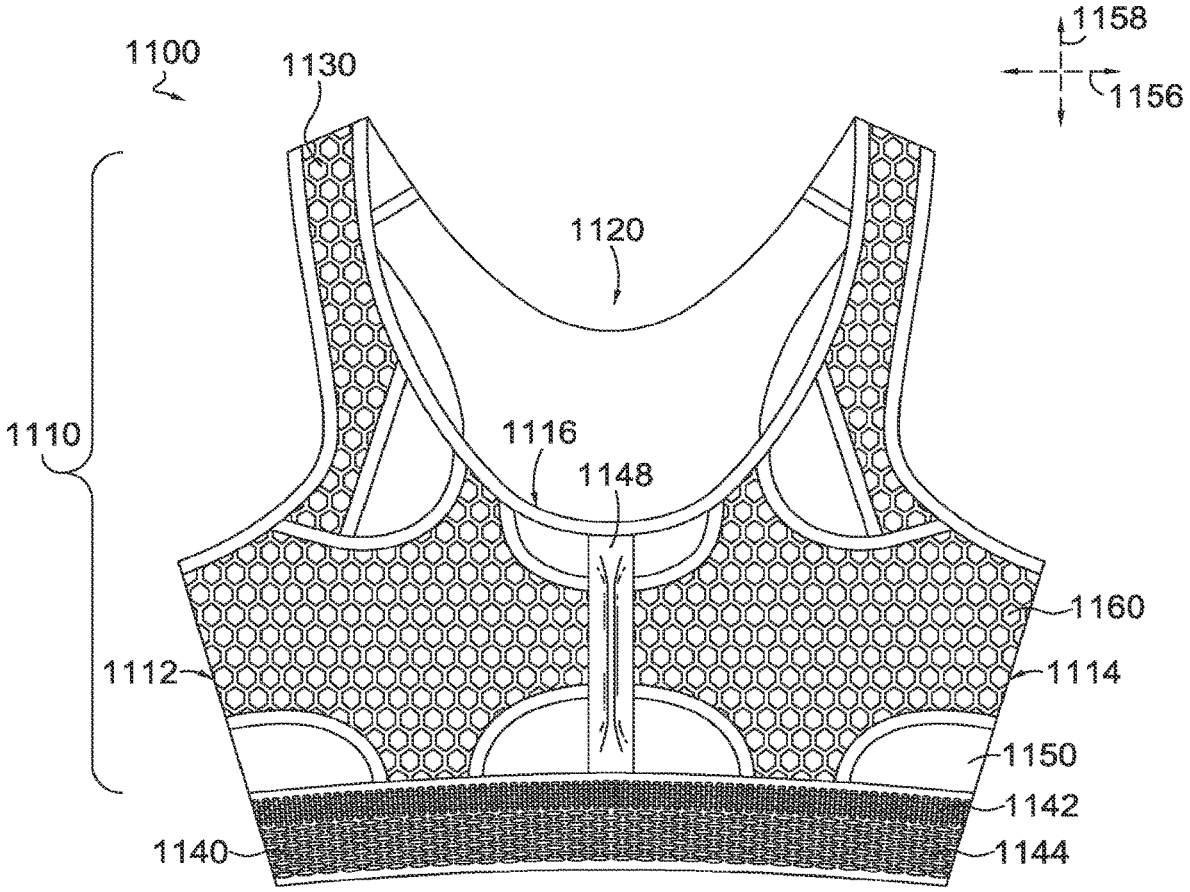
FIG. 10 illustrates a front view of an example quick-drying, lightweight bra in accordance with aspects herein.

FIG. 10 depicts a front view of a bra 1100. In various aspects, the bra 1100 may be targeted to a wearer desiring a medium level support as opposed to the bra 100 shown in FIGS. 1-8, which may be targeted to a wearer desiring a high level of support. The bra 1100 includes a front portion 1110 that generally covers at least a portion of the wearer's chest when the bra 1100 is in an as-worn configuration and a back portion 1120 that generally covers at least a portion of the wearer's back when the bra 1100 is in the as-worn configuration. The front portion 1110 of the bra 1100 may also include a pair of front shoulder straps 1130 each extending from the front portion 1110 towards the back portion 1120. Additionally, the front portion 1110 may be secured to a lower band 1140 configured to extend around at least a portion of the wearer's torso. In some aspects, the front portion 1110 also includes an elastic textile strip 1148 extending vertically between a neckline 1116 of the bra 1100 and the lower band 1140.

The front portion 1110 has a width extending between a right side 1112 and a left side 1114 of the bra 1100. The width of the front portion 1110 between the right side 1112 and the left side 1114 may extend across the wearer's breasts when the bra 1100 is in the as-worn configuration. Thus, the front portion 1110 may be referred to as a breast-covering portion.

In various aspects, the front portion 1110 includes a plurality of mesh panels that at least partially overlap each other. For example, FIG. 10 depicts the front portion 1110 including an exterior panel 1160 and an interior panel 1150. The exterior panel 1160 extends adjacent and external to the interior panel 1150. The exterior panel 1160 and the interior panel 1150 may both extend from the right side 1112 to the left side 1114 of the front portion 1110, and in example aspects, the exterior panel 1160 and the interior panel 1150 each extend seamlessly between the two sides 1112 and 1114.

Figure 11:
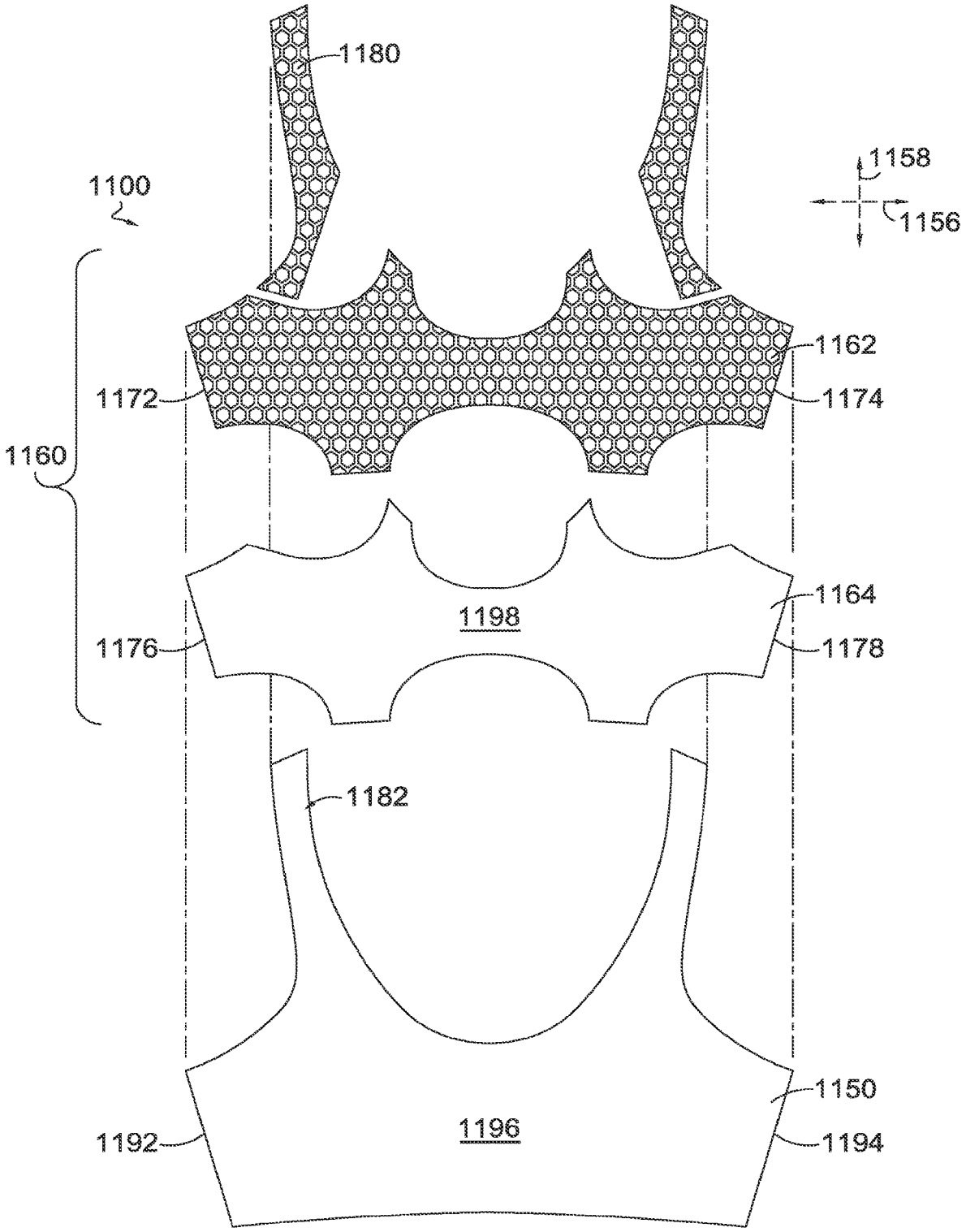
FIG. 11 illustrates an exploded view of a front portion of bra of FIG. 10 in accordance with aspects herein.

FIG. 11 depicts an exploded view of the front portion 1110 of the bra 1100. The exterior panel 1160 may include a first exterior panel 1162 and a second exterior panel 1164. The first exterior panel 1162 may be positioned adjacent and external to at least a portion of an exterior-facing surface 1198 of the second exterior panel 1164. Additionally, the first exterior panel 1162 and the second exterior panel 1164 may have the same or substantially the same width. For example, both panels may extend seamlessly from the right side 1112 to the left side 1114 of the bra 1100 such that a right-side lateral edge 1172 of the first exterior panel 1162 aligns with a right-side lateral edge 1176 of the second exterior panel 1164 and a left-side lateral edge 1174 of the first exterior panel 1162 aligns with a left-side lateral edge 1178 of the second exterior panel 1164. Further, in some aspects, the first exterior panel 1162 and the second exterior panel 1164 may be of the same shape and size. Additionally, in example aspects, the entire first exterior panel 1162 may overlay the entire second exterior panel 1164. In this way, the second exterior panel 1164 may act as a lining to the first exterior panel 1162 in forming the exterior panel 1160. The first exterior panel 1162 and the second exterior panel 1164 may be joined while maintaining their seamless constructions to provide a greater range of movement with respect to the adjacent surfaces of the panels 1162 and 1164. For example, the first exterior panel 1162 and the second exterior panel 1164 may be affixed together along the perimeters of the respective panels while the surfaces are otherwise decoupled from each other. Alternatively, the first exterior panel 1162 may be bonded to the second exterior panel 1164.

Similarly, the interior panel 1150 and the exterior panel 1160 may be joined by affixing the interior panel 1150 and the exterior panel 1160 together along their perimeters while surfaces are otherwise decoupled from each other, providing a greater range a movement within the front portion 1110 of the bra 1100. When the interior panel 1150 and the exterior panel 1160 are joined, the second exterior panel 1164 may be positioned adjacent and external to at least a portion of an exterior-facing surface 1196 of the interior panel 1150. Additionally, the exterior panel 1160 and the interior panel 1150 may have the same or substantially the same width. For example, as each panel extends seamlessly from the right side 1112 to the left side 1114 of the bra 1100, a right-side lateral edge 1192 of the interior panel 1150 may align with the right-side lateral edge 1172 of the first exterior panel 1162 and the right-side lateral edge 1176 of the second exterior panel 1164 while the left-side lateral edge 1194 of the interior panel 1150 may align with the left-side lateral edge 1174 of the first exterior panel 1162 and the left-side lateral edge 1178 of the second exterior panel 1164. In various aspects, the entire exterior panel 1160 overlays the interior panel 1150. As depicted in FIG. 11, the shape of the exterior panel 1160 may be different than the shape of the interior panel 1150. Thus, one or more portions of the exterior-facing surface 1196 of the interior panel 1150 may be visible when the exterior panel 1160 is positioned over the interior panel 1150.

In various aspects, one or more panels of the front portion 1110 may be formed from a mesh material. Further, different mesh materials may be utilized to form different panels of the front portion 1110. For example, the exterior panel 1160 may include a spacer mesh material and a non-spacer mesh material while the interior panel 1150 may include a non-spacer mesh material having different properties, including differing stretch properties, as the spacer mesh material used to at least partially form the exterior panel 1160. In various aspects, the first exterior panel 1162 may include the spacer mesh material, while the second exterior panel 1164 may also be formed from a non-spacer mesh material having different stretch properties.

For example, in various aspects, the first exterior panel 1162 may be formed from a spacer mesh material similar to the spacer mesh material forming the upper support panel 140 and/or the second panel 164 of the bra 100. As such, the first exterior panel 1162 may have anisotropic stretch properties such that the amount of stretch differs along different axes. For example, the first exterior panel 1162 may have more stretch in the widthwise direction corresponding to axis 1156 compared to the lengthwise direction corresponding to axis 1158. For instance, the amount of stretch of the first exterior panel 1162 within the widthwise direction may be within a range from about 1.5 to about 3.5 times, within a range from about 2 to about 3 times, or about 2.67 times the amount of stretch within the lengthwise direction.

In example aspects, the first exterior panel 1162 has a first modulus of elasticity along the widthwise direction that is within a range from about 0.1 lb. forces to about 0.5 lb.

forces with a width loop tension at 40% or from about 0.1 lb. forces to about 0.3 lb. forces at a width loop tension of 40%, and a second modulus of elasticity along the lengthwise direction that is within a range of about 0.5 lb. forces to about 1.5 lb. forces at a width loop tension of 40% or from about 0.8 lb. forces to about 1.3 lb. forces at a width loop tension of 40%. For example, the first modulus of elasticity may be about 0.3 lb. forces with a width loop tension at 40%, while the second modulus of elasticity in the lengthwise direction may be a greater than 0.3 lb. forces with a width loop tension of 40%, thus limiting the stretch in the lengthwise direction.

In contrast to the first exterior panel 1162, the second exterior panel 1164 may include a non-spacer mesh, which may have less stretch than the spacer mesh material forming the first exterior panel 1162. For example, the second exterior panel 1164 may have a third modulus of elasticity in at least one direction that is within a range from about 2.5 lb. forces to about 5.0 lb. forces at a width loop tension of 40%.

The non-spacer mesh of the second exterior panel 1164 may have different amounts of stretch along the widthwise direction corresponding to axis 1156 and the lengthwise direction corresponding to axis 1158. For example, the third modulus of elasticity of the second exterior panel 1164 may be in the widthwise direction, and a fourth modulus of elasticity may be in the lengthwise direction. While the spacer material of the first exterior panel 1162 may have more stretch in the widthwise direction compared to the lengthwise direction, examples of the non-spacer material of the second exterior panel 1164 may have more stretch in the lengthwise direction than in the widthwise direction. Additionally, in some aspects, the difference between the amount of stretch of the second exterior panel 1164 in the widthwise and lengthwise directions is less than the difference between the amount of stretch of the first exterior panel 1162 in the two directions. For example, the amount of stretch of the second exterior panel 1164 within the lengthwise direction may be within a range from about 1.1 to about 2.5 times, within a range from about 1.5 to about 2 times, or about 1.65 times the amount of stretch within the widthwise direction. In contrast, the amount of stretch of the first exterior panel 1162 within the widthwise direction may be within a range from about 1.5 to about 3.5 times, within a range from about 2 to about 3 times, or about 2.67 times the amount of stretch within the lengthwise direction.

In other aspects, the non-spacer mesh is a warp-knit material. For example, the non-spacer mesh may include a combination of polyester yarns and elastomeric yarns such as, for example SPANDEX® or elastane. The amount of polyester forming the non-spacer mesh may be within a range from about 70% to about 85% or within a range from about 75% to about 80%, while the amount of elastane may be within a range from about 30% to about 15% or within a range from about 25% to about 20%. For example, in one aspect, the non-spacer mesh has a composition of about 78% polyester and about 22% elastane.

Additionally, the mesh forming the second exterior panel 1164 may have a weight within a range from about 190 grams per square meter to about 240 grams per square meter or from about 105 grams per square meter to about 225 grams per square meter. For example, in one aspect, the weight is about 216 grams per square meter. The weight of the material forming the second exterior panel 1164 may help provide coverage of and support within a breast-contacting region while the open mesh structure creates a highly breathable and quick drying panel.

Further, the interior panel 1150 may include a non-spacer mesh material that has less stretch than the spacer mesh material forming the first exterior panel 1162. For example, the interior panel 1150 may have a fifth modulus of elasticity in at least one direction that is within a range from about 1.5 lb. forces to about 3 lb. forces at a width loop tension of 40% or from about 1.5 lb. forces to about 2.2 lb. forces at a width loop tension of 40%.

The non-spacer mesh of the interior panel 1150 may have different amounts of stretch along the widthwise direction corresponding to axis 1156 and the lengthwise direction corresponding to axis 1158. In some aspects, the fifth modulus of elasticity of the interior panel 1150 is in the widthwise direction, and the interior panel 1150 includes a sixth modulus of elasticity in the lengthwise direction. While the spacer material of the first exterior panel 1162 may have more stretch in the widthwise direction compared to the lengthwise direction, examples of the non-spacer material of the interior panel 1150 may have more stretch in the lengthwise direction than in the widthwise direction. Additionally, in some aspects, the difference between the amount of stretch of the interior panel 1150 in the widthwise and lengthwise directions is less than the difference between the amount of stretch of the first exterior panel 1162 in the two directions. For example, the amount of stretch of the interior panel 1150 within the lengthwise direction may be within a range from about 1.1 to about 2.5 times, within a range from about 1.5 to about 2 times, or about 1.65 times the amount of stretch within the widthwise direction. In contrast, as previously stated, the amount of stretch of the first exterior panel 1162 within the widthwise direction may be within a range from about 1.5 to about 3.5 times, within a range from about 2 to about 3 times, or about 2.67 times the amount of stretch within the lengthwise direction.

In example aspects, the non-spacer mesh material of the interior panel 1150 may be different than the non-spacer mesh material of the second exterior panel 1164. For example, the weight (in grams per square meter) of the non-spacer mesh material of the interior panel 1150 may be less than the weight of the non-spacer mesh of the second exterior panel 1164. In some aspects, the non-spacer mesh of the interior panel 1150 has a weight within a range from about 15 grams per square meter to about 200 grams per square meter or from 25 grams per square meter to about 180 grams per square meter. For instance, the interior panel 1150 may have a weight of 100 grams per square meter. Utilizing a lighter weight material for the interior panel 1150 helps maintain a lightweight characteristic of the bra 1100 overall. Similar to the first exterior panel 1162 and the second exterior panel 1164, the open mesh structure of the interior panel 1150 may create a highly breathable and quick drying panel.

Additionally, FIG. 11 depicts exterior strap panels 1180, which may be formed from a spacer mesh material similar to the material forming the first exterior panel 1162. Because the spacer mesh material may have less stretch in the lengthwise direction, forming the exterior strap panels 1180 from the spacer mesh material reduces stretch in the lengthwise direction, which maintains support to the wearer's breasts while still providing stretch in the widthwise direction to allow for increased comfort and ease when donning and doffing the bra 1100.

The exterior strap panels 1180 may form an exterior layer of the front shoulder straps 1130 of the bra 1100. Where the breast-contacting region of the front portion 1110 may have a three-layered construction that aids in the increased support and desired coverage, the front shoulder straps 1130 may have a two-layered construction. For example, the two exterior strap panels 1180 in FIG. 11 may each overlay a strap portion 1182 of the interior panel 1150 to form the front shoulder straps 1130. This two-layered construction aids in breathability and allows for a quick drying time, while maintaining lightweight characteristics of the bra.

Figure 12:
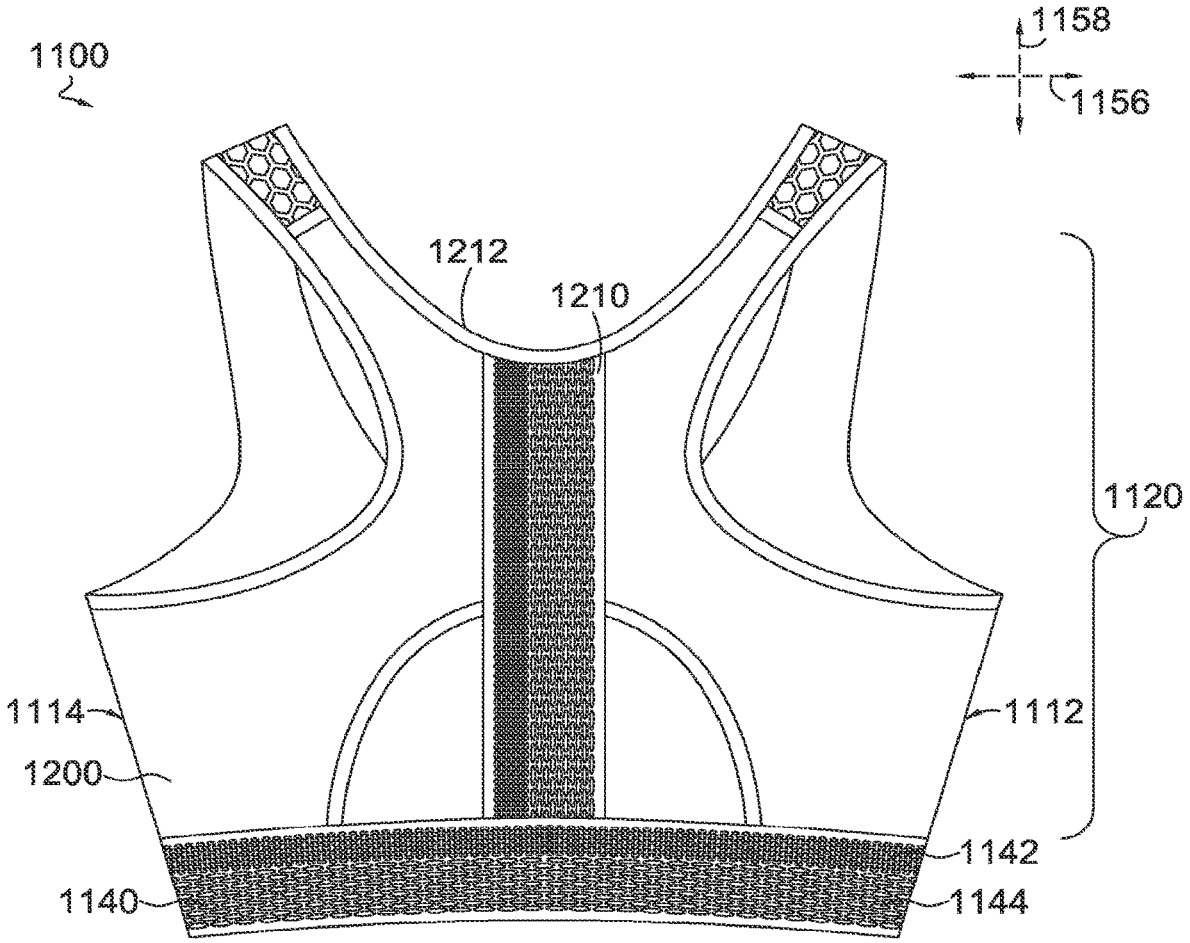
FIG. 12 illustrates a back view of the bra of FIG. 10 in accordance with aspects herein.

FIG. 12 depicts a back view of the bra 1100. The back portion 1120 of the bra 1100 includes a back panel 1200, which may extend seamlessly from the right side 1112 to the left side 1114 of the bra 1100. In example aspects, the back panel 1200 includes a non-spacer mesh material, which allows for breathability and quick drying. In various aspects, the back panel 1200 includes the same non-spacer mesh material as the second exterior panel 1164 of the exterior panel 1160. In alternative aspects, the back panel 1200 includes the same non-spacer mesh material as the interior panel 1150.

The back panel 1200 is secured to each of the front shoulder straps 1130 and the lower band 1140. The lower band 1140 may be secured to the back panel 1200 and one or more panels of the front portion 1110 of the bra 1100 and may comprise an elastic textile material that encircles the wearer's torso. The lower band 1140 may extend continuously along the back portion 1120 from at least the right side 1112 to the left side 1114 of the bra 1100 such that the bra 1100 may be donned and doffed by pulling the bra 1100 over the wearer's head. It is contemplated, however, that alternative configurations of the bra 1100 include one or more releasable coupling mechanisms attached to ends of the lower band 1140.

In various aspects, the lower band 1140 includes a plurality of apertures to increase air flow to the wearer's skin. In some aspects, different sized apertures are positioned throughout the lower band 1140. For example, in FIG. 12, a top portion of lower band 1140 includes apertures 1142 of a first size, and a bottom portion of the lower band 1140 includes apertures 1144 of a second size that is larger than the first size. In some aspects, the back portion 1120 of the bra 1100 also includes an elastic band 1210 extending vertically from a top edge 1212 of the back panel 1200 to the lower band 1140 and positioned external to the back panel 1200. The elastic band 1210 may also include a plurality of apertures of the same or varying sizes, which increase breathability and allow for a lightweight construction and quick drying time.

Figure 13:
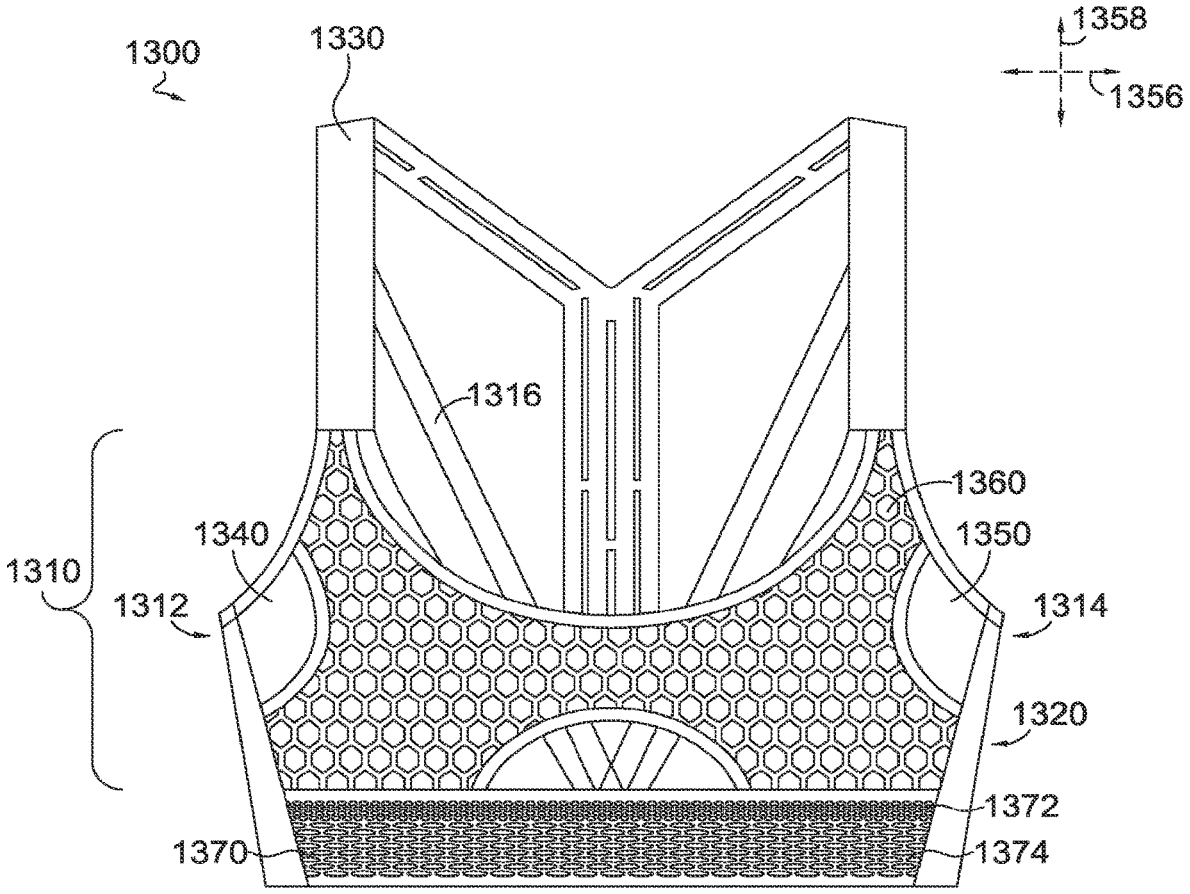
FIG. 13 illustrates a front view of an example quick-drying, lightweight bra in accordance with aspects herein.

FIG. 13 depicts a front view of a bra 1300. In various aspects, the bra 1300 may be targeted toward a wearer desiring a light level support, as opposed to the bra 100 of FIGS. 1-8 and bra 1100 of FIGS. 10-12, which may be targeted toward a wearer desiring high and medium levels of support, respectively. The bra 1300 includes a front portion 1310 that typically covers at least a portion of the wearer's chest when the bra 1300 is in an as-worn configuration and a back portion 1320 that typically covers at least a portion of the wearer's back when the bra 1300 is in the as-worn configuration. The front portion 1310 of the bra 1300 may also include a pair of shoulder straps 1330 that each extend from the front portion 1310 towards the back portion 1320.

In some aspects, the front portion 1310 is secured to a lower band 1370. The lower band 1370 may include an elastic textile material that is configured to at least partially encircle the wearer's torso when the bra 1300 is in the as-worn configuration. As such, the lower band 1370 may be secured to one or more panels of the front portion 1310 of the bra 1300. In various aspects, the lower band 1370 includes a plurality of apertures, which increases breathability and allows for a lightweight construction and quick drying time. In some aspects, the lower band 1370 includes apertures of varying sizes. For example, in FIG. 13, a top portion of the lower band 1370 includes apertures 1372 of a first size, and a bottom portion of the lower band 1370 includes apertures 1374 of a second size that is larger than the first size. Varying the size of apertures in the lower band 1370 may, for example, direct airflow toward areas of the wearer in which increased airflow is desired.

The front portion 1310 of the bra 1300 has a width extending between a right side 1312 and a left side 1314 of the bra 1300. The width of the front portion 1310 between the right side 1312 and the left side 1314 may extend across the wearer's breasts when the bra 1300 is in the as-worn configuration. Thus, the front portion 1310 may be referred to as a breast-covering portion.

In some aspects, the front portion 1310 includes a plurality of mesh panels that at least partially overlap each other. For example, FIG. 13 depicts the front portion 1310 including an exterior panel 1360 extending seamlessly from the right side 1312 to the left side 1314 of the front portion 1310. The front portion 1310 also includes a first interior panel 1340 and a second interior panel 1350. The exterior panel 1360 may extend adjacent and external to both the first interior panel 1340 and the second interior panel 1350. The first interior panel 1340 may be adjacent the right side 1312 of the front portion 1310 and generally configured to cover a wearer's right breast, while the second interior panel 1350 may be adjacent the left side 1314 of the front portion 1310 and generally configured to cover a wearer's left breast. In some aspects, the first interior panel 1340 and the second interior panel 1350 may be generally the same size and shape such that they are mirror images of each other when incorporated into the front portion 1310 of the bra 1300.

Figure 14:
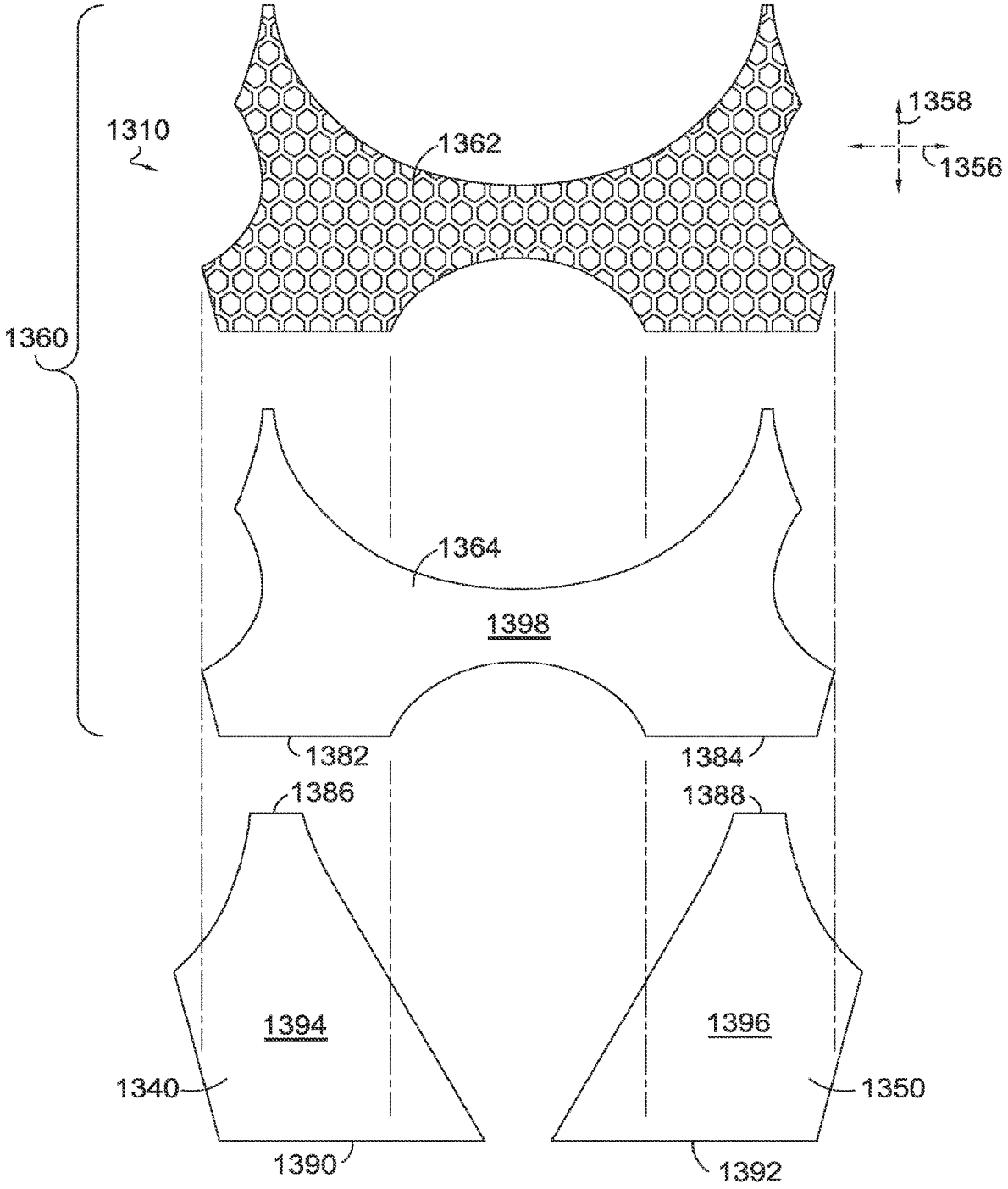
FIG. 14 illustrates an exploded view of a front portion of the bra of FIG. 13 in accordance with aspects herein.

FIG. 14 depicts an exploded view of the front portion 1310 of the bra 1300. The exterior panel 1360 includes a first exterior panel 1362 and a second exterior panel 1364. The first exterior panel 1362 is adjacent and external to at least a portion of an exterior-facing surface 1398 of the second exterior panel 1364. In some aspects, the first exterior panel 1362 and the second exterior panel 1364 have the same or substantially the same width. For example, both panels may extend seamlessly from the right side 1312 to the left side 1314 of the bra 1300. Further, in some aspects, the first exterior panel 1362 and the second exterior panel 1364 may have the same size and shape. However, panels having different sizes and shapes are also contemplated herein. In various aspects, the entire first exterior panel 1362 overlays the entire second exterior panel 1364. In this way, the second exterior panel 1364 may act as a lining to the first exterior panel 1362 to form the exterior panel 1360. The first exterior panel 1362 and the second exterior panel 1364 may be joined while maintaining their seamless constructions to provide a greater range of movement. For example, the first exterior panel 1362 and the second exterior panel 1364 may be affixed together along the perimeters of the respective panels while the surfaces are otherwise decoupled from each other. Alternatively, the first exterior panel 1362 may be bonded to the second exterior panel 1364.

In some aspects, the exterior panel 1360 is positioned adjacent and external to the interior panels 1340 and 1350. More specifically, a first portion of the second exterior panel 1364 is positioned adjacent and external to at least a portion of an exterior-facing surface 1394 of the first interior panel 1340, and a second portion of the second exterior panel 1364 is positioned adjacent and external to at least a portion of an exterior-facing surface 1396 of the second interior panel 1350. As such, the second exterior panel 1364 is positioned between the first exterior panel 1362 and the first and second interior panels 1340 and 1350, respectively.

In various aspects, the first and second interior panels 1340 and 1350 are joined to the exterior panel 1360 along a portion of the perimeter of the first and second interior panels 1340 and 1350. For example, an area immediately adjacent the bottom edge 1390 of the first interior panel 1340 may be joined to an area immediately adjacent a bottom edge 1382 of the second exterior panel 1364, while the exterior-facing surface 1394 and side edges of the first interior panel 1340 may be otherwise decoupled from the second exterior panel 1364. Similarly, an area immediately adjacent the bottom edge 1392 of the second interior panel 1350 may be joined to an area immediately adjacent a bottom edge 1384 of the second exterior panel 1364, while the exterior-facing surface 1396 and side edges of the second interior panel 1350 may be otherwise decoupled from the second exterior panel 1364. In some aspects, the top edges 1386 and 1388 of first exterior panel 1362 and the second exterior panel 1364 are also decoupled from the second exterior panel 1364 but may each be secured to a shoulder strap 1330. This arrangement, for example, permits a greater range of movement. In alternative aspects, the top edges 1386 and 1388 may be affixed to a portion of the second exterior panel 1364.

In various aspects, one or more panels of the front portion 1310 may be formed from a mesh material. Further, different mesh materials may be utilized to form different panels of the front portion 1310. For example, the exterior panel 1360 may include a spacer mesh material and a non-spacer mesh material, while the first interior panel 1340 and the second interior panel 1350 may include a non-spacer mesh material having different properties (e.g., differing stretch properties) than the spacer mesh material. Similarly, the first exterior panel 1362 may include the spacer mesh material while the second exterior panel 1364 may include a non-spacer mesh material having different stretch properties.

For example, the first exterior panel 1362 may be formed from a spacer mesh material similar to the spacer mesh material forming the upper support panel 140 and/or the second panel 164 of the bra 100. As such, the first exterior panel 1362 may have anisotropic stretch properties such that the amount of stretch differs along different axes. For example, the first exterior panel 1362 may have more stretch (and thus, a lower modulus of elasticity) in the widthwise direction corresponding to axis 1356 compared to the lengthwise direction corresponding to axis 1358. The amount of stretch of the first exterior panel 1362 within the widthwise direction may be within a range from about 1.5 to about 3.5 times, within a range from about 2 to about 3 times, or about 2.67 times the amount of stretch within the lengthwise direction. In an example aspect, the first exterior panel 1362 has a first modulus of elasticity along the widthwise direction that is within a range from about 0.1 lb. forces to about 0.5 lb. forces at a width loop tension of 40% or from 0.1 lb. forces to about 0.3 lb. forces at a width loop tension of 40%, and a second modulus of elasticity along the lengthwise direction within a range from about 0.5 lb. forces to 1.5 lb. forces at a width loop tension of 40% or from about 0.8 lb. forces to about 1.3 lb. forces at a width loop tension of 40%. For example, the first modulus of elasticity in the widthwise direction may be about 0.3 lb. forces at a width loop tension of 40%, while the second modulus of elasticity in the lengthwise direction may be greater than 0.3 lb. forces with a width loop tension of 40%, thus limiting stretch in the lengthwise direction.

In contrast to the first exterior panel 1362, the second exterior panel 1364 may be formed of a non-spacer mesh material having less stretch than the first exterior panel 1362 in at least one direction. For example, a third modulus of elasticity of the second exterior panel 1364 may be within a range from about 2.5 lb. forces to about 5.0 lb. forces at a width loop tension of 40%. In various aspects, the second exterior panel 1364 has different amounts of stretch along the widthwise direction corresponding to axis 1356 and the lengthwise direction corresponding to axis 1358. For example, the third modulus of elasticity of the second exterior panel 1364 may be along the widthwise direction, and the second exterior panel 1364 may have a fourth modulus of elasticity the lengthwise direction. While the spacer material of the first exterior panel 1362 may have more stretch in the widthwise direction compared to the lengthwise direction, examples of the non-spacer material of the second exterior panel 1364 may have more stretch in the lengthwise direction than in the widthwise direction.

Additionally, in some aspects, the difference between the amount of stretch of the second exterior panel 1364 in the widthwise direction and lengthwise direction is less than the difference between the amount of stretch of the first exterior panel 1362 in the two directions. For example, the amount of stretch of the second exterior panel 1364 within the lengthwise direction may be within a range from about 1.1 to about 2.5 times, within a range from about 1.5 to about 2 times, or about 1.65 times the amount of stretch within the widthwise direction. In contrast, the amount of stretch of the first exterior panel 1362 within the widthwise direction may be within a range from about 1.5 to about 3.5 times, within a range from about 2 to about 3 times, or about 2.67 times the amount of stretch within the lengthwise direction.

In other aspects, the non-spacer mesh is a warp-knit material. For example, the non-spacer mesh may include a combination of polyester yarns and elastomeric yarns such as SPANDEX® or elastane. For example, in one aspect, the non-spacer mesh has a composition of approximately 78% polyester and approximately 22% elastane.

Additionally, the mesh forming the second exterior panel 1364 may have a weight within a range from about 190 grams per square meter to about 240 grams per square meter or from about 105 grams per square meter to about 225 grams per square meter. For example, in one aspect, the weight is approximately 216 grams per square meter. The weight of the material forming the second exterior panel 1364 may help provide support within a breast-contacting region while the open mesh structure increases breathability and allows for a quick drying panel.

Further, each of the first interior panel 1340 and the second interior panel 1350 may also include a non-spacer mesh material that has less stretch than the spacer mesh material forming the first exterior panel 1362. For example, the first interior panel 1340 and the second interior panel 1350 each may have a fifth modulus of elasticity in at least one direction that is within a range from about 1.5 lb. forces to about 3 lb. forces at a width loop tension of 40% or from about 1.5 lb. forces to about 2.2 lb. forces at a width loop tension of 40%.

The non-spacer mesh material of the first interior panel 1340 and the second interior panel 1350 may have different amounts of stretch along the widthwise direction corresponding to axis 1356 and the lengthwise direction corresponding to axis 1358. In some aspects, the fifth modulus of elasticity of the first interior panel 1340 and the second interior panel 1350 is in the widthwise direction, and the first interior panel 1340 and the second interior panel 1350 may each have a sixth modulus of elasticity in the lengthwise direction. While the spacer material of the first exterior panel 1362 may have more stretch in the widthwise direction compared to the lengthwise direction, examples of the non-spacer material of the first interior panel 1340 and the second interior panel 1350 may have more stretch in the lengthwise direction than in the widthwise direction. Additionally, in some aspects, the difference between the amount of stretch of the first interior panel 1340 and the second interior panel 1350 in the widthwise direction and the lengthwise direction is less than the difference between the amount of stretch of the first exterior panel 1362 in the two directions. For example, the amount of stretch of in each of the first interior panel 1340 and the second interior panel 1350 within the lengthwise direction may be within a range from about 1.1 to about 2.5 times, within a range from about 1.5 to about 2 times, or about 1.65 times the amount of stretch within the widthwise direction of the respective panel. In contrast, as previously stated, the amount of stretch of the first exterior panel 1362 within the widthwise direction may be within a range from about 1.5 to about 3.5 times, within a range from about 2 to about 3 times, or about 2.67 times the amount of stretch within the lengthwise direction.

In some aspects, the non-spacer mesh of the first interior panel 1340 and the second interior panel 1350 may be different than the non-spacer mesh of the second exterior panel 1364. For example, the weight (in grams per square meter) of the non-spacer mesh of the first interior panel 1340 and the second interior panel 1350 may be less than the weight of the non-spacer mesh of the second exterior panel 1364. In some aspects, the non-spacer mesh of the first interior panel 1340 and the second interior panel 1350 has a weight within a range from about 15 grams per square meter to about 200 grams per square meter or from 25 grams per square meter to about 180 grams per square meter. For instance, the first interior panel 1340 and the second interior panel 1350 may each have a weight of 100 grams per square meter. Utilizing a lighter weight material for the first interior panel 1340 and the second interior panel 1350 helps maintain a lightweight characteristic of the bra 1300 overall.

Further, in some aspects, the bra 1300 also includes one or more elastic straps 1316 that each extend diagonally between a top margin of the lower band 1370 and one of the shoulder straps 1330. Each elastic strap 1316 may be partially positioned adjacent and interior to the exterior panel 1360 and may be positioned medial to the first and second interior panels 1340 and 1350, respectively. These elastic straps 1316 may, for example, provide additional support to the wearer while eliminating the need for an additional layer of material, which allows for the increased breathability, quick dry time, and lightweight construction.

Figure 15:
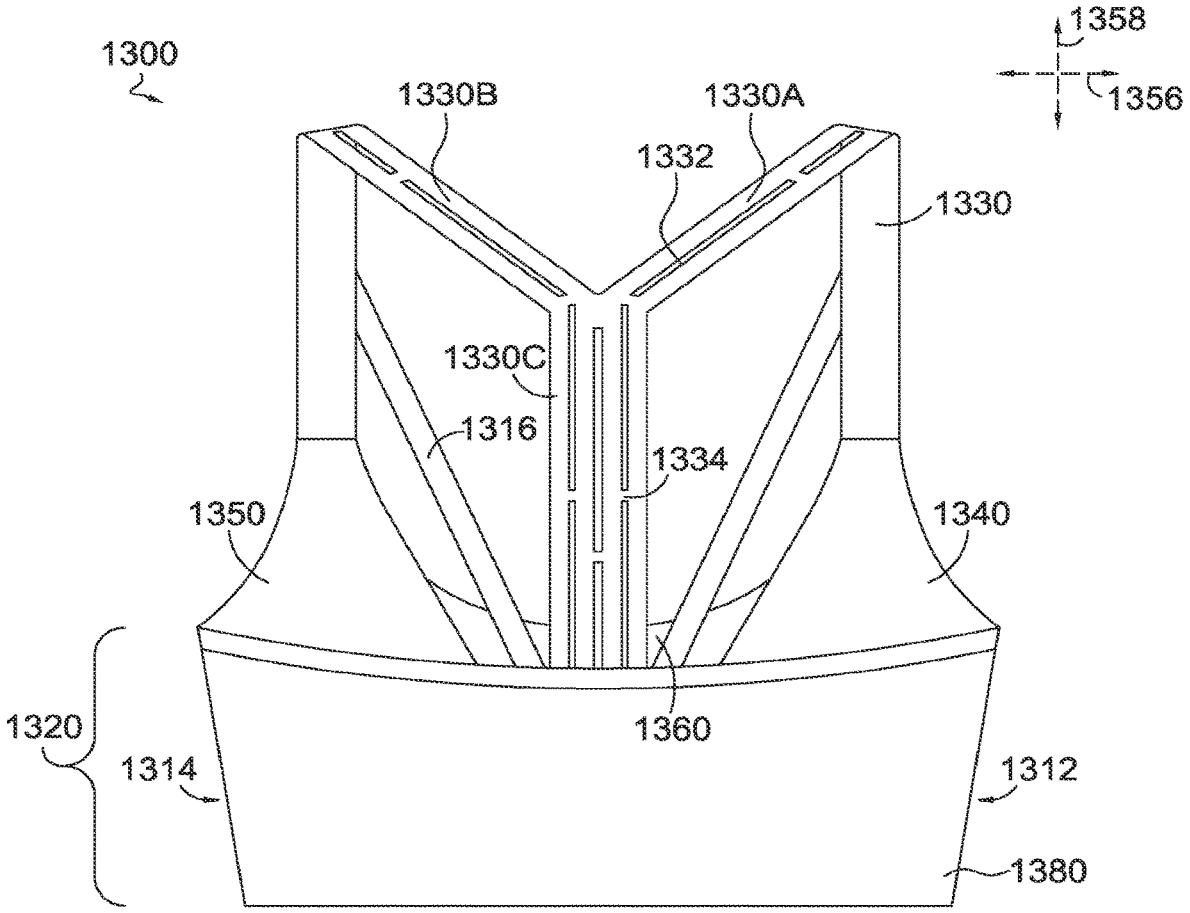
FIG. 15 illustrates a back view of the bra of FIG. 13 in accordance with aspects herein.

FIG. 15 depicts a back view of the bra 1300. The back portion 1320 of the bra 1300 includes a back panel 1380, which may extend seamlessly from the right side 1312 to the left side 1314 of the bra 1300. The back panel 1380 may include a non-spacer mesh material such that the back panel 1380 remains breathable and quick drying. In various aspects, the back panel 1380 includes the same non-spacer mesh material as the second exterior panel 1364. In alternative aspects, the back panel 1380 includes the same non-spacer mesh material as the first and second interior panels 1340 and 1350.

The back panel 1380 is secured to the shoulder straps 1330. In some aspects, the shoulder straps 1330 include a right shoulder strap portion 1330A and a left shoulder strap portion 1330B that are joined to form a back shoulder strap portion 1330C, which is secured to the back panel 1380. The shoulder straps 1330 may include a plurality of apertures 1332. In some aspects, the right shoulder strap portion 1330A, the left shoulder strap portion 1330B, and the back shoulder strap portion 1330C each includes multiple elastics straps that are intermittently connected at connection points 1334 such that the apertures 1332 are the spaces between unconnected portions of the individual straps. However, it is contemplated that, in alternative configurations, each shoulder strap portion may be formed from a single strap and the apertures 1332 may be integrally formed with the single strap or created in a post-production process such as through cutting, slicing, lasering, and the like. The apertures 1332 within the shoulder straps 1330 help maintain the increased breathability, quick drying time, and lightweight characteristics of the bra 1300.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are illustrative in nature and are not limiting.

Clause 1: A bra with a front portion having a right side and a left side, the bra comprising:

an interior support panel assembly having a first panel formed from a mesh material and extending between the right side and the left side of the front portion, and a second panel formed from a spacer mesh material and extending between the right side and the left side of the front portion, wherein the second panel is positioned adjacent and external to the first panel;

an upper support panel formed from a spacer mesh material and extending between the right side and the left side of an upper part of the front portion, wherein the upper support panel is positioned adjacent and external to the interior support panel assembly; and a lower support panel formed from a mesh material and extending between the right side and the left side of a lower part of the front portion, wherein the lower support panel is positioned adjacent and external to the interior support panel assembly.

Clause 2: The bra according to clause 1, wherein the upper support panel includes an upper support panel top edge and an upper support panel bottom edge, and wherein the upper support panel top edge forms an upper margin of the front portion of the bra.

Clause 3: The bra according to any of clauses 1 through 2, wherein the lower support panel includes a lower support panel top edge and a lower support panel bottom edge, and wherein the lower support panel bottom edge forms a lower margin of the front portion of the bra.

Clause 4: The bra according to any of clauses 1 through 3, wherein at least a portion of the upper support panel bottom edge is positioned superior to at least a portion of the lower support panel top edge.

Clause 5: The bra according to any of clauses 1 through 4, wherein the first panel of the interior support panel assembly extends seamlessly between the right side and the left side of the front portion of the bra.

Clause 6: The bra according to any of clauses 1 through 5, wherein the second panel of the interior support panel assembly includes a third panel affixed to a right side of the second panel and configured to at least partially cover a right breast of a wearer, and a fourth panel affixed to a left side of the second panel and configured to at least partially cover a left breast of the wearer, wherein the third panel and the fourth panel are formed from a low stretch material.

Clause 7: The bra according to any of clauses 1 through 6, wherein each of the third panel and the fourth panel are affixed to an exterior-facing surface of the second panel.

Clause 8: The bra according to any of clauses 1 through 7, further comprising a back portion extending from the front portion, the back portion formed from a mesh material.

Clause 9: The bra according to any of clauses 1 through 8, further comprising a pair of shoulder straps extending between the front portion and the back portion, the pair of shoulder straps formed from a spacer mesh material.

Clause 10: A bra with a front portion having a right side, a left side, an upper margin, and a lower margin, the bra comprising:

an interior support panel assembly extending between the right side and the left side of the front portion;

an upper support panel positioned adjacent and external to the interior support panel assembly, the upper support panel having an upper support panel top edge that forms at least a portion of the upper margin of the front portion and an upper support panel bottom edge that is positioned superior to the lower margin of the front portion; and a lower support panel positioned adjacent and external to the interior support panel assembly, the lower support panel including a lower support panel top edge that is positioned inferior to the upper margin of the front portion and a lower support panel bottom edge that forms the lower margin of the front portion.

Clause 11: The bra according to clause 10, wherein at least a portion of the upper support panel bottom edge is positioned superior to at least a portion of the lower support panel top edge.

Clause 12: The bra according to any of clauses 10 through 11, wherein at least a portion of the lower support panel top edge is unaffixed from the interior support panel assembly to form a pocket opening in communication with a pocket space formed between the lower support panel and the interior support panel assembly.

Clause 13: The bra according to any of clauses 10 through 12, wherein the interior support panel assembly includes a first panel extending between the right side and the left side of the front portion, and a second panel extending between the right side and the left side of the front portion, wherein the second panel is positioned adjacent and external to the first panel.

Clause 14: The bra according to any of clauses 10 through 13, wherein the second panel of the interior support panel assembly includes a third panel affixed to a right side of the second panel and configured to at least partially cover a right breast of a wearer, and a fourth panel affixed to a left side of the second panel and configured to at least partially cover a left breast of the wearer.

Clause 15: The bra according to any of clauses 10 through 14, wherein the third panel and the fourth panel are formed from a low stretch material.

Clause 16: The bra according to any of clauses 10 through 15, wherein the first panel is formed from a mesh material, the second panel is formed from a spacer mesh material, the upper support panel is formed from a spacer mesh material, and the lower support panel is formed from a mesh material.

Clause 17: The bra according to any of clauses 10 through 16, wherein the first panel has a greater modulus of elasticity than the second panel, and wherein the lower support panel has a greater modulus of elasticity than the upper support panel.

Clause 18: The bra according to any of clauses 10 through 17, further comprising a back portion extending from the front portion, the back portion formed from a mesh material.

Clause 19: A method of manufacturing a bra comprising: forming a front portion of the bra by:

affixing at one or more locations an upper support panel to an interior support panel assembly such that the upper support panel is positioned adjacent to a first surface of the interior support panel assembly, the upper support panel including an upper support panel bottom edge; and affixing at one or more locations a lower support panel to the interior support panel assembly such that the lower support panel is positioned adjacent to the first surface of the interior support panel assembly, the lower support panel including a lower support panel top edge that is positioned inferior to at least a portion of the upper support panel bottom edge.

Clause 20: The method of manufacturing the bra according to clause 19, wherein the upper support panel further includes an upper support panel top edge that forms an upper margin of the front portion, and wherein the lower support panel further includes a lower support panel bottom edge that forms a lower margin of the front portion.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. An upper-body support garment comprising:

a front portion that includes a lower support panel and an upper support panel;

the lower support panel comprising:

a first left side edge and a first right side edge;

a first breast covering portion and a second breast covering portion, each positioned between the first left side edge and the first right side edge;

a lower middle portion positioned between the first breast covering portion and the second breast covering portion; and a top edge of the lower middle portion that comprises a first concave contour;

the upper support panel comprising:

a second left side edge and a second right side edge;

an upper middle portion positioned between the second left side edge and the second right side edge; and a bottom edge of the upper middle portion that comprises a second concave contour, wherein the bottom edge is positioned superior to the lower support panel, wherein the top edge and the bottom edge overlap to form a central opening defined by the first concave contour and the second concave contour.

2. The upper-body support garment of claim 1, wherein the lower support panel extends seamlessly between a right side and a left side of the front portion.

3. The upper-body support garment of claim 1, wherein the lower support panel is affixed to a first shoulder strap and a second shoulder strap.

4. The upper-body support garment of claim 1, wherein the front portion further comprises an interior support assembly comprising a third panel affixed to a right side of the lower support panel and configured to at least partially cover a right breast of a wearer, and a fourth panel affixed to a left side of the lower support panel and configured to at least partially cover a left breast of the wearer.

5. The upper-body support garment of claim 1, further comprising a back portion extending from the front portion, the back portion formed from a mesh material.

6. The upper-body support garment of claim 5, further comprising a pair of shoulder straps extending between the front portion and the back portion, the pair of shoulder straps comprising the mesh material.

7. The upper-body support garment of claim 1, wherein the upper support panel extends from a right side to a left side of the front portion and forms an upper margin of the front portion.

8. The upper-body support garment of claim 7, wherein the upper support panel is formed from a spacer mesh material, the spacer mesh material having anisotropic stretch properties.

9. The upper-body support garment of claim 8, wherein the spacer mesh material of the upper support panel has a first modulus of elasticity in a widthwise direction, and a second modulus of elasticity in a lengthwise direction, wherein the first modulus of elasticity is greater than the second modulus of elasticity.

10. The upper-body support garment of claim 1, wherein the lower support panel extends from a right side to a left side of the front portion and forms a lower margin of the front portion.

11. The upper-body support garment of claim 1, wherein the lower support panel comprises a non-spacer mesh material, the non-spacer mesh material comprising a modulus of elasticity greater than that of the upper support panel.

12. The upper-body support garment of claim 11, wherein the non-spacer mesh material of the lower support panel has a third modulus of elasticity in a widthwise direction and a fourth modulus of elasticity in a lengthwise direction, wherein the third modulus of elasticity is greater than the fourth modulus of elasticity.

13. The upper-body support garment of claim 1, wherein the lower support panel overlaps with the upper support panel, with at least about 50% of the lower support panel positioned superior to the upper support panel.

14. An upper-body support garment comprising:

a front portion that includes a lower support panel and an upper support panel, wherein the lower support panel comprises a mesh material and the upper support panel comprises a spacer mesh material;

the lower support panel comprising:

a first left side edge and a first right side edge;

a first breast covering portion and a second breast covering portion, each positioned between the first left side edge and the first right side edge;

a lower middle portion positioned between the first breast covering portion and the second breast covering portion; and a top edge of the lower middle portion that comprises a first concave contour;

the upper support panel comprising:

a second left side edge and a second right side edge;

an upper middle portion positioned between the second left side edge and the second right side edge; and a bottom edge that comprises a second concave contour, wherein the bottom edge is positioned superior to the lower support panel, wherein the top edge and the bottom edge overlap to form a central opening defined by the first concave contour and the second concave contour.

15. The upper-body support garment of claim 14, wherein the lower support panel extends seamlessly between a right side and a left side of the front portion.

16. The upper-body support garment of claim 14, wherein the lower support panel is affixed to a first shoulder strap and a second shoulder strap.

17. The upper-body support garment of claim 14, wherein the front portion further comprises an interior support assembly comprising a third panel affixed to a right side of the lower support panel and configured to at least partially cover a right breast of a wearer, and a fourth panel affixed to a left side of the lower support panel and configured to at least partially cover a left breast of the wearer.

18. The upper-body support garment of claim 14, further comprising a back portion extending from the front portion, the back portion formed from the mesh material.

19. The upper-body support garment of claim 18, further comprising a pair of shoulder straps extending between the front portion and the back portion, the pair of shoulder straps comprising the mesh material.

20. An upper-body support garment comprising:

a front portion that includes a lower support panel and an upper support panel, wherein the lower support panel and the upper support panel define a central opening;

wherein the lower support panel comprises:

a first left side edge and a first right side edge;

a first breast covering portion and a second breast covering portion, each positioned between the first left side edge and the first right side edge;

a lower middle portion positioned between the first breast covering portion and the second breast covering portion; and a top edge;

wherein the upper support panel comprises:

a second left side edge and a second right side edge;

an upper middle portion positioned between the second left side edge and the second right side edge; and a bottom edge;

wherein the central opening is defined by:

the top edge of the lower support panel comprising a first concave contour; and the bottom edge of the upper support panel comprising a second concave contour;

wherein the bottom edge of the upper support panel is positioned superior to the top edge of the lower support panel, and the first concave contour and the second concave contour are shaped to define a perimeter of the central opening.

* * * * *